United States Patent [19]

Takahashi

[11] Patent Number: 5,021,328

[45] Date of Patent: Jun. 4, 1991

[54] SILVER HALIDE COLOR PHOTOGRAPHIC MATERIALS

[75] Inventor: Osamu Takahashi, Kanagawa, Japan

[73] Assignee: Fuji Photo Film Co., Ltd., Minami-ashigara, Japan

[21] Appl. No.: 545,591

[22] Filed: Jun. 29, 1990

[30] Foreign Application Priority Data

Jun. 30, 1989 [JP] Japan ..... 1-168895

[51] Int. Cl.[5] ..... G03C 7/26; G03C 7/32; G03C 7/34

[52] U.S. Cl. ..... 430/502; 430/505; 430/546; 430/551

[58] Field of Search ..... 430/551, 505, 214, 502, 430/546

[56] References Cited

U.S. PATENT DOCUMENTS

| | | | |
|---|---|---|---|
| 4,562,146 | 12/1985 | Masuda et al. | 430/551 |
| 4,732,845 | 3/1988 | Keiji et al. | 430/551 |
| 4,762,773 | 8/1988 | Takahashi et al. | 430/551 |
| 4,774,166 | 9/1988 | Sasaki et al. | 430/551 |
| 4,898,811 | 2/1990 | Wolff et al. | 430/551 |

FOREIGN PATENT DOCUMENTS

| | | |
|---|---|---|
| 125522 | 11/1984 | European Pat. Off. . |
| 145342 | 6/1985 | European Pat. Off. . |
| 307935 | 3/1989 | European Pat. Off. . |

*Primary Examiner*—Richard L. Schilling
*Attorney, Agent, or Firm*—Burns, Doane, Swecker & Mathis

[57] ABSTRACT

A silver halide color photographic material comprising a support having thereon (i) at least one silver halide light-sensitive emulsion layer containing substantially silver iodide free silver halide with a silver chloride content of at least 90 Mol %, (ii) at least one coupler which forms a dye by means of a coupling reaction with the oxidized product of a primary aromatic amine developing agent, and (iii) at least one light-insensitive layer containing at least one oil soluble anti-color mixing agent which reacts with the oxidized product of the developing agent, said light-insensitive layer containing at least one oil soluble and substantially non-diffusible anti-color mixing promotor selected from the group consisting of compounds represented by general formula (I) or general formula (II):

(I)

wherein A represents a divalent electron attractive group, $R_1$ represents an aliphatic group, an aryl group, an alkoxy group, an aryloxy group, an alkylamino group, an anilino group, a heterocyclic ring-amino group or a heterocyclic group, l represents 1 or 2, $R_2$ represents an aliphatic group, an alkoxy group, a hydroxyl group or a halogen, m represents an interger of value from 0 to 4, and a benzene ring or heterocyclic ring formed by Q may be condensed with the benzene ring, in formula (I);

$$HO—R_3 \quad (II)$$

wherein $R_3$ represents an aliphatic group having a total number of carbon atoms of at least 12; said anti-color mixing promotor may form a dimer or more polymer.

17 Claims, No Drawings

SILVER HALIDE COLOR PHOTOGRAPHIC MATERIALS

FIELD OF THE INVENTION

This invention relates to silver halide photographic materials which are suitable for rapid processing and which provide high quality images with little color mixing and excellent color separation. More precisely, the invention relates to silver halide photographic materials which contain anti-color mixing promotors.

BACKGROUND OF THE INVENTION

Silver halide photographic photosensitive materials of high picture quality which can be subjected to rapid processing have become desirable in this field in recent years.

Development processing of silver halide photographic photosensitive materials is generally carried out continuously in automatic processors which have been installed in processing laboratories. As part of the user service it is now generally required that the material be processed and returned to the user on the same day that it is submitted for development. More recently a demand has also arisen for return within 1 hour of receipt. As a result, the necessity for rapid processing becomes ever more pronounced. Moreover, a shortening of processing time improves production efficiency and allows costs to be cut so great progress has been made with rapid processing.

The form, size and composition of silver halide gains in emulsions used in the photosensitive materials is known to have a considerable effect upon the rate of development under these circumstances. For example, the halogen composition has a pronounced effect, and especially high rates of development can be observed when silver halides which have a high chloride content are used.

Furthermore, it has become desirable not to include benzyl alcohol in color development baths in recent years from the viewpoints of environmental protection and reducing the operational burden of preparing color development solutions. Furthermore, sulphites which have been used as antioxidants for developing agents, etc., in color development solutions, reacts with couplers competitively with the oxidized product of the color developing agents, thus lowering the image density. The colored dye densities change if the amount of sulfite present in the color development solution changes. Therefore, the omission of sulfite from the color development solution is also desirable.

Against this background, high chloride silver halides have recently been used for color papers. Also, methods of processing with color developers which are essentially benzyl alcohol and sulfite free have come into practical use.

However, color mixing is liable to occur when high chloride silver halides are used. It is believed that because of the very high rate of silver development, the proportion of the oxidized product of developing agent produced by silver development which diffuse into other layers rather than reacting with the couplers in the layer in which it is formed is increased relative to that which occurs with slow silver development. Furthermore this phenomenon is promoted with the aforementioned color developers which contain no benzyl alcohol or sulfite.

Increasing the thickness of the intermediate layers which are located between the emulsion layers and increasing the amount of anti-color mixing agent are ways of resolving this problem, but a considerable increase is required to improve color mixing to a satisfactory level. Also, the cost is high, and the rapidity of processing is reduced by increasing the film thickness.

SUMMARY OF THE INVENTION

In the light of the above, the first object of the present invention is to provide silver halide photographic materials which are suitable for rapid processing.

Another object of the invention is to provide silver halide photographic materials which show little color mixing and which exhibit excellent color separation and color reproduction, even when subjected to rapid processing.

Even another object of the invention is to provide a method of forming a color image which provides color photographs exhibiting little color mixing and having excellent color separation and color reproduction.

Accordingly, one embodiment of the invention relates to a silver halide color photographic material comprising a support having thereon (i) at least one silver halide light-sensitive emulsion layer containing substantially silver iodide free silver halide with a silver chloride content of at least 90 mol%, (ii) at least one coupler which forms a dye by means of a coupling reaction with the oxidized product of a primary aromatic amine developing agent, and (iii) at least one light-insensitive layer containing at least one oil soluble anti-color mixing agent which reacts with the oxidized product of the developing agent, said light-insensitive layer containing at least one oil soluble and substantially non-diffusible anti-color mixing promotor selected from the group consisting of compounds represented by general formula (I) or general formula (II):

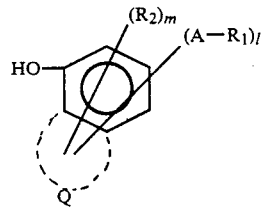

(I)

wherein A represents a divalent electron attractive group, $R_1$ represents an aliphatic group, an aryl group, an alkoxy group, an aryloxy group, an alkylamino group, an anilino group, a heterocyclic ring-amino group or a heterocyclic group, l represents 1 or 2, $R_2$ represents an aliphatic group, an alkoxy group, a hydroxyl group or a halogen, m represents an integer of value from 0 to 4, and a benzene ring or heterocyclic ring formed by Q may be condensed with the benzene ring, in formula (I);

$$HO—R_3 \quad (II)$$

wherein $R_3$ represents an aliphatic group having a total number of carbon atoms of at least 12. These anti-color mixing promotors may form a dimer or more polymer.

In another embodiment, the aforementioned coupler is a pyrazoloazole coupler.

In another embodiment, a method of forming a color image is provided wherein the aforementioned silver halide color photographic material is subjected to imagewise exposure and then processed in a color development solution which is essentially benzyl alcohol free.

In another embodiment, a method of forming color images is provided wherein the aforementioned color development solution is essentially sulfite ion free.

DETAILED DESCRIPTION OF THE INVENTION

The compounds of general formula (I) and general formula (II) are described in more detail below.

In the present invention "substantially non-diffusible compound" means that the compound does not diffuse to other layers during or after coating thereof. In order to provide such a property to the compound, it is preferred to make the compound has at least one substituent containing at least 8 carbon atoms. Alternatively, the compound may be made to be bulky compound by bonding moieties of the compound of formula (I) or (II) to a polymer (which is not water soluble) chain.

It is preferred that —A—$R_1$ is present at the position with respect to the phenolic hydroxy group in formula (I).

A in general formula (I) is preferably an electron attractive group which can be represented by

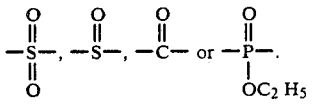

In general formula (I) and general formula (II) the aliphatic groups include substituted and unsubstituted, linear chain and branched chain alkyl, aralkyl, alkenyl, alkynyl, cycloalkyl and cycloalkenyl groups. The aryl groups include substituted and unsubstituted aryl groups such as phenyl, 4-tert-butylphenyl, 2,4-di-tert-amylphenyl and naphthyl groups. The alkoxy groups include substituted and unsubstituted alkoxy groups such as methoxy, ethoxy, benzyloxy, heterodecyloxy and octadecyloxy groups. The aryloxy groups include substituted and unsubstituted aryloxy groups such as phenoxy, 2-methylphenoxy, and naphthoxy groups. The alkylamino groups include substituted and unsubstituted alkylamino groups such as methylamino, butylamino and octylamino groups. The anilino groups include substituted and unsubstituted anilino groups such as phenylamino, 2-chloroanilino, and 3-dodecyloxycarbonylanilino groups.

The heterocyclic ring in the heterocyclic group or heterocyclic ring-amino (-thio or -oxy) group in the present invention is preferably a 5- to 7-membered heterocyclic ring containing at least one of O, S and N atoms as hetero atom.

Specific examples of heterocyclic rings include a pyrazolyl ring, an imidazolyl ring, a triazolyl ring, a pyridyl ring, a quinolyl ring, a piperidyl ring and triazinyl groups, and these groups may also form the heterocyclic ring of heterocyclic ring-amino groups.

The halogen atoms are, for example, chlorine, bromine and iodine.

Further examples of substituent groups of the substituted alkyl groups, substituted aralkyl groups, substituted alkenyl groups, substituted alkinyl groups, substituted cycloalkyl groups, substituted cycloalkenyl groups, substituted aryl groups, substituted alkoxy groups, substituted aryloxy groups, substituted alkylamino groups, substituted anilino groups, substituted heterocyclic ring-amino groups and substituted heterocyclic groups of $R_1$, $R_2$ and $R_3$ include, for example halogen atoms, alkyl groups, aryl groups, heterocyclic groups, cyano groups, alkoxy groups, aryloxy groups heterocyclic ring-oxy groups, aliphatic or aromatic acyloxy groups, carbamoyloxy groups, silyloxy groups, aliphatic or aromatic sulfonyloxy groups, aliphatic or aromatic acylamino groups, anilino groups, ureido groups, imido groups, sulfamoylamino groups, carbamoylamino groups, alkylthio groups, arylthio groups, heterocyclic ring-thio groups, alkoxycartonylamino groups, aryloxycarbonylamino groups, aliphatic or aromatic sulfonamido groups, carbamoyl groups, aliphatic or aromatic acyl groups, sulfamoyl groups, aliphatic or aromatic sulfonyl groups, aliphatic or aromatic sulfinyl groups, alkoxycarbonyl groups, aryloxycarbonyl groups, alkenyl groups and alkenyloxy groups.

The oil soluble compounds of general formula (I) preferably have at least 10 carbon atoms in the molecule.

Specific examples of oil soluble anti-color mixing promotors represented by general formulae (I) and (II) are indicated below, but the invention is not intended to be limited to these examples.

(I-1)

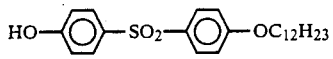

(I-2)

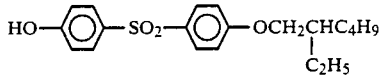

(I-3)

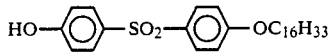

(I-4)

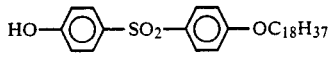

(I-5)

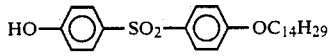

(I-6)

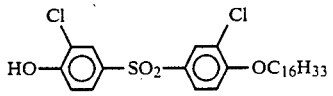

(I-7)

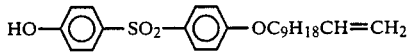

(I-8)

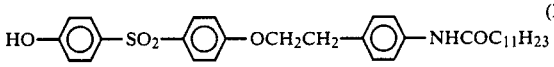

(I-9)

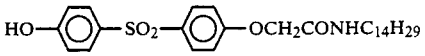

(I-10)

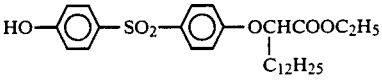

(I-11)

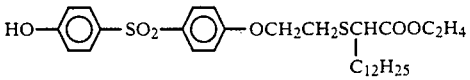

(I-12)

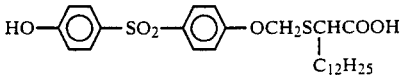

-continued
(I-13)
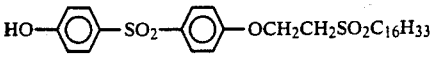
(I-14)
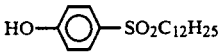
(I-15)
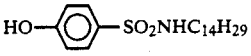
(I-16)
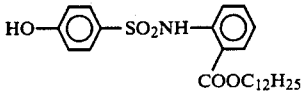
(I-17)
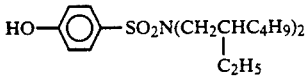
(I-18)
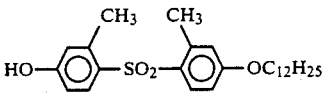
(I-19)
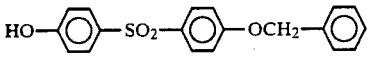
(I-20)
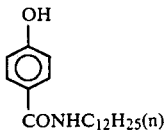
(I-21)
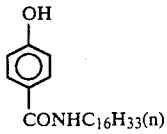
(I-22)
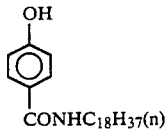
(I-23)
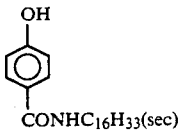
(I-24)
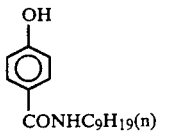
(I-25)
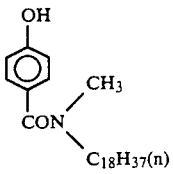
-continued
(I-26)
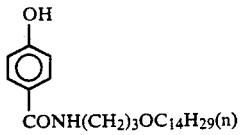
(I-27)
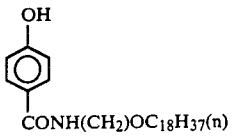
(I-28)
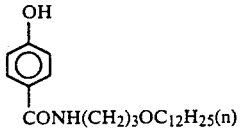
(I-29)
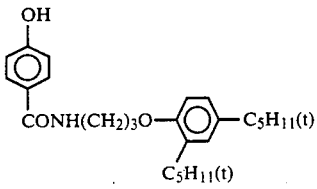
(I-30)
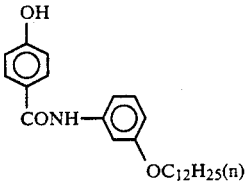
(I-31)
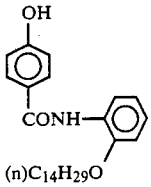
(I-32)
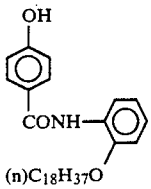
(I-33)
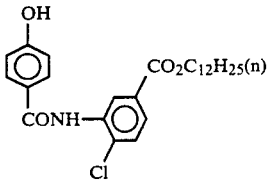
(I-34)
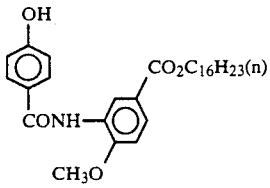

-continued
(I-35)
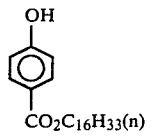
(I-36)
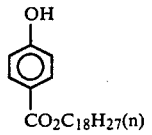
(I-37)
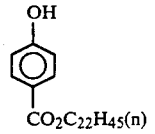
(I-38)
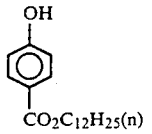
(I-39)
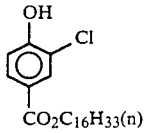
(I-40)
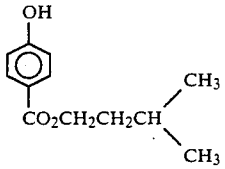
(I-41)
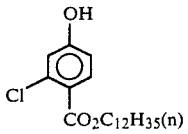
(I-42)
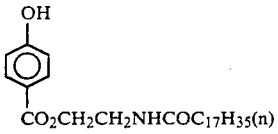
(I-43)
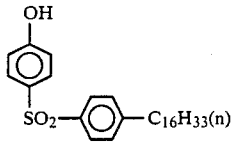
(I-44)
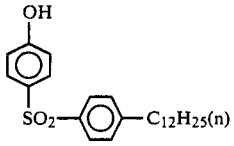
(I-45)
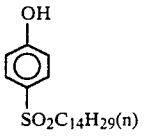
-continued
(I-46)
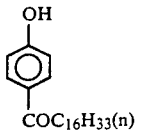
(I-47)
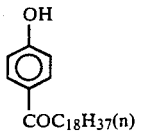
(I-48)
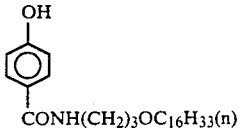
(I-49)
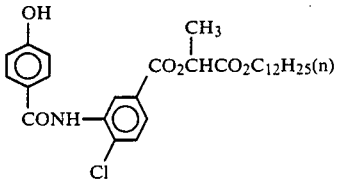
(I-50)
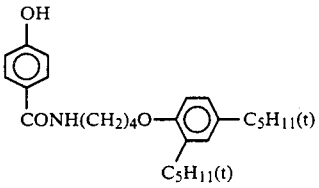
(I-51)
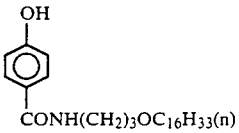
(I-52)
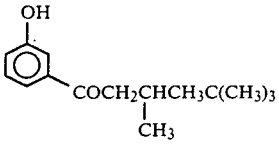
(I-53)
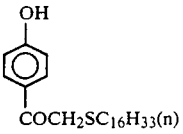
(I-54)
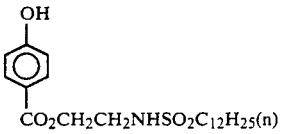
(I-55)
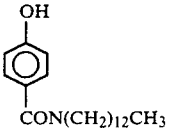
(I-56)
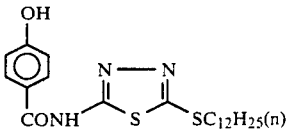

-continued (I-57)

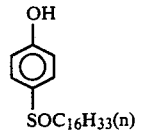

(I-58)

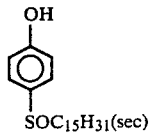

(I-59)

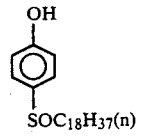

(I-60)

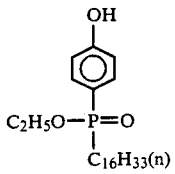

(I-61)

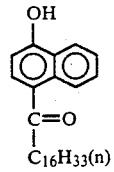

(II-1) $CH_3(CH_2)_{10}CH_2OH$ (II-2) $CH_3(CH_2)_{11}CH_2OH$ (II-3) $CH_3(CH_2)_{12}CH_2OH$ (II-4) $CH_3(CH_2)_{13}CH_2OH$ (II-5) $CH_3(CH_2)_{14}CH_2OH$ (II-6) $CH_3(CH_2)_{15}CH_2OH$ (II-7) $CH_3(CH_2)_{16}CH_2OH$ (II-8) $CH_3(CH_2)_{17}CH_2OH$ (II-9) $CH_3(CH_2)_{18}CH_2OH$ (II-10)

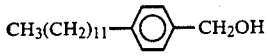

(II-11)

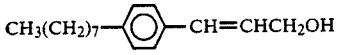

(II-12) $C_{10}H_{21}O(CH_2)_5O(CH_2)_2OH$ (II-13)

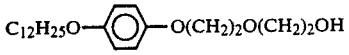

(II-14)

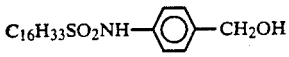

(II-15)

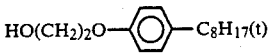

The anti-color mixing promotors to be used in the present invention can generally be added to the light-insensitive layer (which is usually a hydrophilic colloidal layer) using known oil in water dispersion methods as oil protection method. The anti-color mixing agent and the anti-color mixing promotor are preferably dissolved in a solvent and then coemulsified by dispersion in an aqueous gelatin solution which contains a surfactant. Alternatively, water or an aqueous gelatin solution can be added to the above-mentioned solution and an oil in water dispersion can be obtained by phase reversal. The solvent need not be used in those cases where the anti-color mixing agent plays the part of a solvent in the oil droplets.

The average diameter of the oil droplets is suitably from 0.04 to 0.35 μm, preferably from 0.04 to 0.25 μm, and most desirably from 0.04 to 0.20 μm.

The amount of anti-color mixing promotor to be used can vary over a wide range depending on the type and quantity of anti-color mixing agent which is being used. But, the anti-color mixing promotor/anti-color mixing agent ratio by weight is preferably from 0.05 to 2, and most desirably from 0.1 to 1. The amount of anti-color mixing agent used is preferably from 7 to 400 mg/m$^2$, and most desirably from 10 to 210 mg/m$^2$.

The light-insensitive layer (anti-color mixing layer) to which the anti-color mixing agents and anti-color mixing promotors are added is, for example, an intermediate layer which is established between light-sensitive layers (e.g., between a red sensitive layer and a green sensitive layer or between a green sensitive layer and a blue sensitive layer), or a layer which is established between a light-sensitive layer and a protective layer (for example, a layer which contains an ultraviolet absorber).

As the preferred oil soluble anti-color mixing agents various reducing agents, such as hydroquinones, can be used as the oil soluble anti-color mixing agents in the present invention. The alkylhydroquinones are the most common. Mono-alkyl substituted hydroquinone useful in intermediate layers are described for example, in U.S. Pat. Nos. 2,360,290, 2,419,613, 2,403,721, 3,960,570 and 3,700,453, JP-A-49-106329 and JP-A-50-156438. Dialkyl substituted hydroquinones are described, for example, in U.S. Pat. Nos. 2,728,659, 2,732,300, 3,243,294 and 3,700,453, JP-A-50-156438 JP-A-53-9528, JP-A-53-55121, JP-A-54-29637 and JP-A-60-55339. (The term "JP-A" as used herein signifies an "unexamined published Japanese patent application"). Using alkylhydroquinoes represented by general formula (HQ-1) indicated below for the anti-color mixing agents is preferred in the present invention.

(HQ-1)

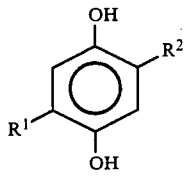

In the above formula, $R^1$ and $R^2$, which may be the same or different, each represents a hydrogen atom, or a substituted or unsubstituted alkyl group, preferably having 1 to 20 carbon atoms such as methyl, tert-butyl, n-octyl, sec-octyl, tert-octyl, sec-dodecyl, tert-pentadecyl, sec-octadecyl groups, and at least one of $R^1$ and $R^2$ is an alkyl group.

Using hydroquinone sulfonates such as those disclosed in JP-A-60-172040, as anti-color mixing agents is also desirable. The hydroquinone derivatives represented by general formula (HQ-2) below are preferred as the anti-color mixing agents in the present invention.

(HQ-2)

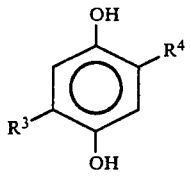

In the above formula, $R^3$ represents a substituted or unsubstituted alkyl group, alkylthio group, amido group or alkyloxy group, and $R^4$ represents a sulfo group or a sulfoalkyl group such as a sulfopropyl group.

The use of amidohydroquinoes as anti-color mixing agents is also desirable. Such compounds are described in JP-A-59-202465, JP-A-62-103638 and JP-A-62-150346. Amidohydroquinones preferably used as anti-color mixing agents are represented by general formula (RD-1) below.

(RD-1)

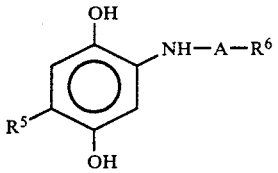

In the above formula, $R^5$ represents a hydrogen atom, a halogen atom or a substituted or unsubstituted alkyl group, A represents

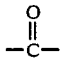

or —$SO_2$—, and $R^6$ represents a substituted or unsubstituted alkyl group or an aryl group.

The anti-color mixing agents represented by formula (HQ-1), (HQ-2) or (RD-1) may form a dimer or more polymer.

The use of the hydroquinones which have electron withdrawing substituent groups such as those disclosed in JP-A-55-43521, JP-A-56-109344 and JP-A-57-22237, as well as the alkylhydroquinones, hydroquinone sulfonates and amidohydroquinones represented by the general formulae described above, as anti-color mixing agents is desirable. Specific examples of hydroquinones which are preferred as anti-color mixing agents are set forth below.

(HQ-1)

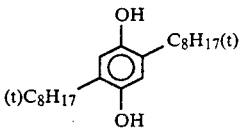

(HQ-2)

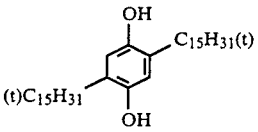

(HQ-3)

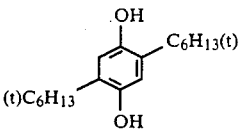

-continued (HQ-4)

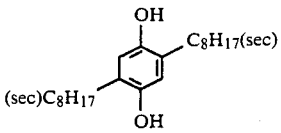

(HQ-5)

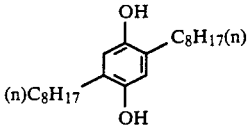

(HQ-6)

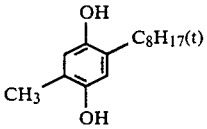

(HQ-7)

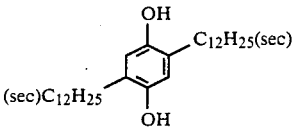

(HQ-8)

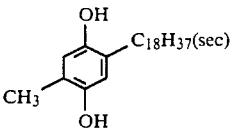

(HQ-9)

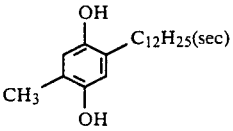

(HQ-10)

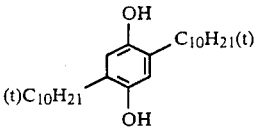

(HQ-11)

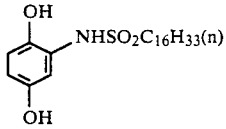

(HQ-12)

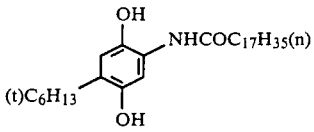

(HQ-13)

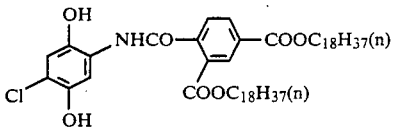

(HQ-14)

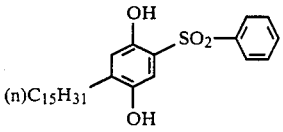

(HQ-15)

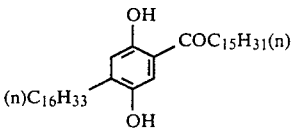

-continued (HQ-16)

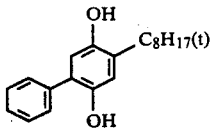

(HQ-17)

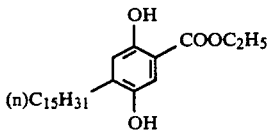

(HQ-18)

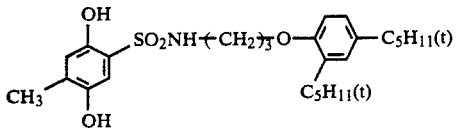

(HQ-19)

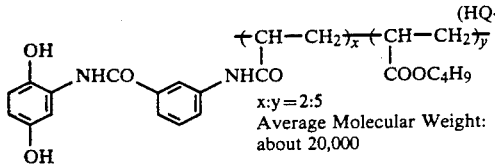

x:y=2:5
Average Molecular Weight: about 20,000

(HQ-20)

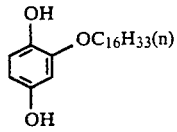

(HQ-21)

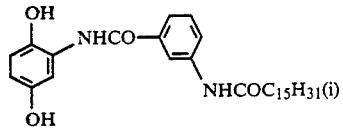

(HQ-22)

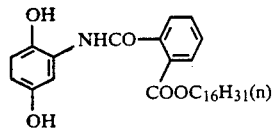

(HQ-23)

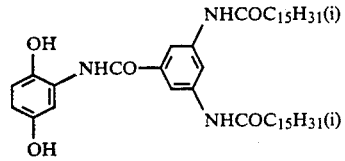

(HQ-24)

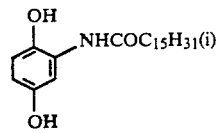

(HQ-25)

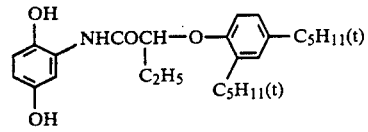

(HQ-26)

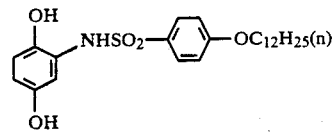

Reducing agents which have skeletons other than hydroquinone can also be used as anti-color mixing agents. Examples include tri-hydric phenols such as the gallic acid amides disclosed in JP-A-58-156933 and the sulfonamidophenols disclosed in JP-A-59-2547 and JP-A-59-202465. Specific examples are set forth below.

(RD-1)

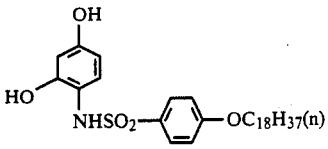

(RD-2)

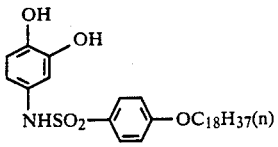

(RD-3)

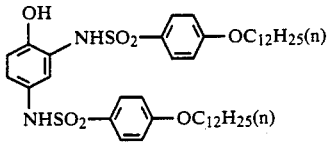

(RD-4)

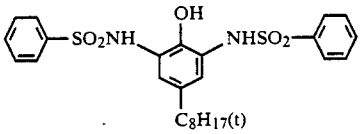

(RD-5)

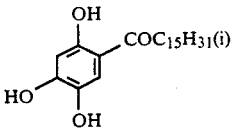

(RD-6)

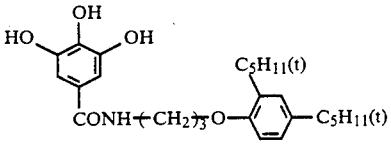

(RD-7)

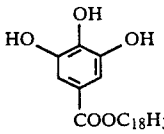

(RD-8)

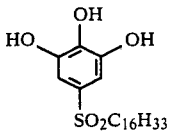

(RD-9)

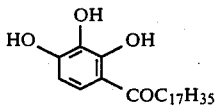

(RD-10)

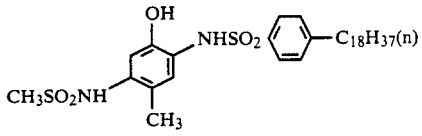

The hydroquinones described an anti-color mixing agents are also preferred as the hydroquinones which can be added to the emulsion layers in this present invention to provide contrast controlling effect. Alkylhydroquinones and hydroquinonesulfonates are especially desirable in this respect.

The high boiling point organic solvents which are used according to the present invention to disperse the oil soluble photographically useful compounds such as the anti-color mixing agents, anti-color mixing promotors and couplers, are preferably liquid or solid organic substances at normal temperature and compatible with the oil soluble photographically useful substances. Compounds represented by general formulae (III) to (VII) set forth below are preferred.

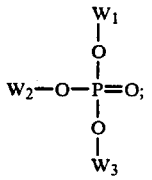

(III)

$W_1-COO-W_2$; (IV)

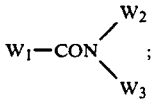

(V)

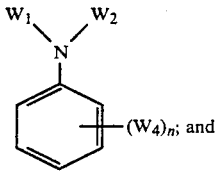

(VI)

$W_1-O-W_2$ (VII)

In the above formulae, $W_1$, $W_2$ and $W_3$, which may be the same or different, represent a substituted or unsubstituted alkyl group, cycloalkyl group, alkenyl group, aryl group or heterocyclic group, $W_4$ represents $W_1$, O-$W_1$ or S-$W_1$, and n represents an integer of from 1 to 5, and when n is 2 or more the $W_4$ groups may be the same or different. Moreover, $W_1$ and $W_2$ in general formula (VII) may form a condensed ring by bonding together.

The amount of high boiling point organic solvent can vary widely, depending on the type and quantity of anti-color mixing agent. But, the high boiling point organic solvent/anti-color mixing agent ratio, by weight, is preferably from 0.05 to 20, and most desirably from 0.1 to 10. Among compounds represented by general formulae (III) to (VII), those represented by the formula (III), (IV) or (V) are preferred.

Specific examples of high boiling point solvents which can be used in the present invention are set forth below, although the invention is not intended to be limited to the examples.

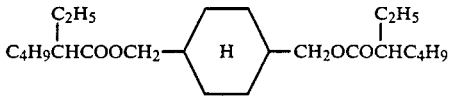

(S-1)

$O=P(OCH_2CH_2CHCH_3)_3$ (S-2)

-continued

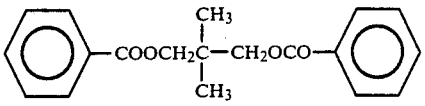

(S-3)

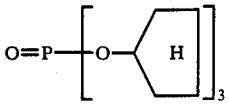

(S-4)

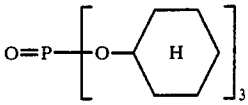

(S-5)

$O=P-(OC_8H_{17}^{EH})_3$ (S-6)

(Where $C_8H_{17}^{EH}$ represents $-CH_2CHC_4H_9$; same below)

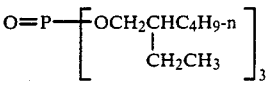

(S-7)

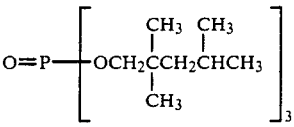

(S-8)

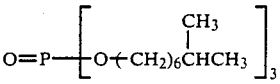

(S-9)

$O=P(OC_9H_{19}\text{-}n)_3$ (S-10)

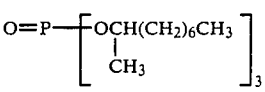

(S-11)

$O=P(OC_{10}H_{21}\text{-}n)_3$ (S-12)

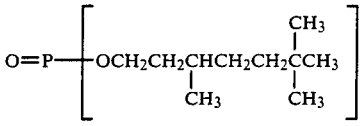

(S-13)

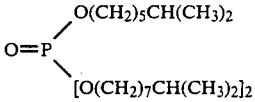

(S-14)

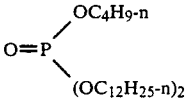

(S-15)

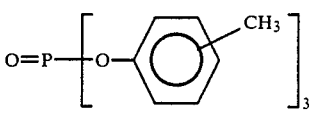

(S-16)

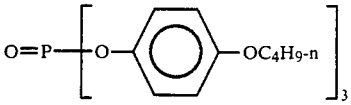

(S-17)

-continued
(S-18)
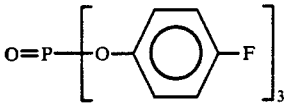
(S-19)
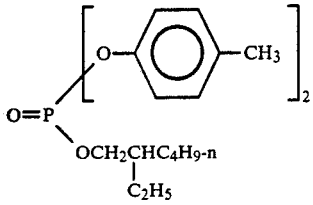
(S-20)
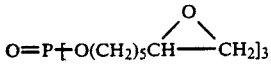
(S-21)
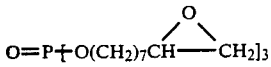
(S-22)
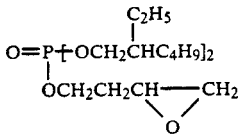
(S-23)
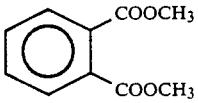
(S-24)
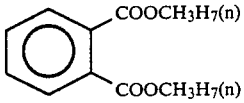
(S-25)
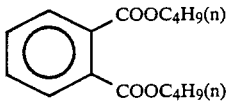
(S-26)
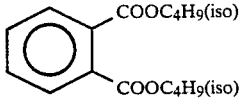
(S-27)
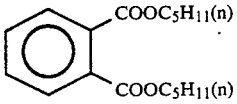
(S-28)
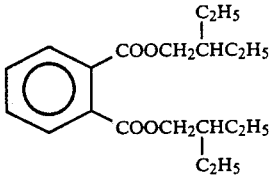
(S-29)
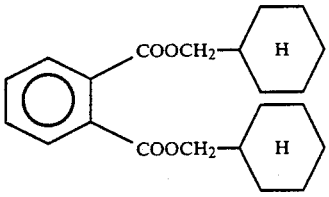
-continued
(S-30)
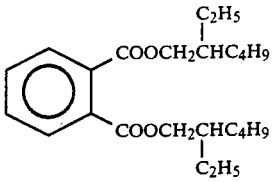
(S-31)
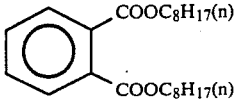
(S-32)
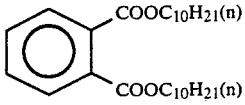
(S-33)
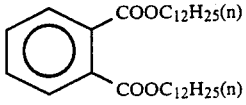
(S-34)
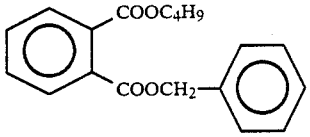
(S-35)
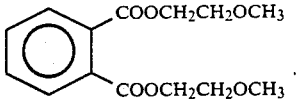
(S-36)
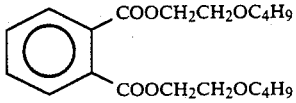
(S-37)
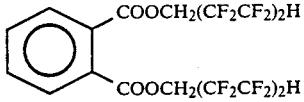
(S-38)
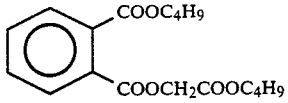
(S-39)
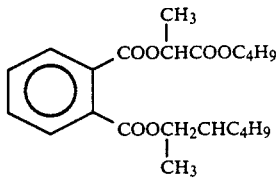
(S-40)
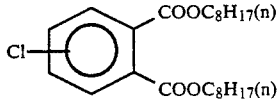
(S-41)
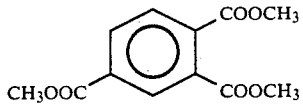

-continued
(S-42)
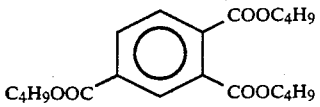
(S-43)
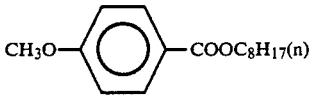
(S-44)
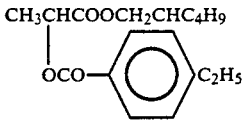
(S-45)
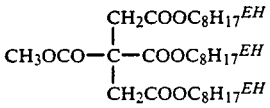
(S-46)
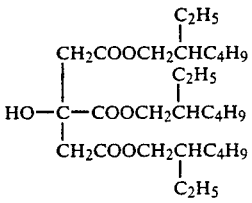
(S-47)
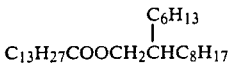
(S-48)
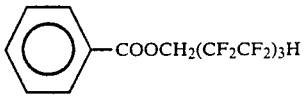
(S-49)
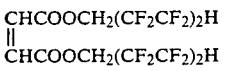
(S-50)
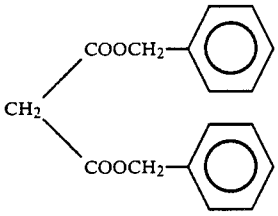
(S-51)
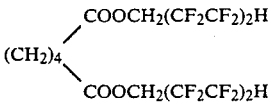
(S-52)
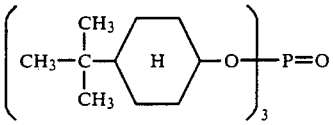
(S-53)
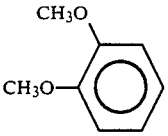
-continued
(S-54)
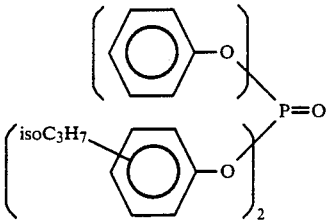
(S-55)
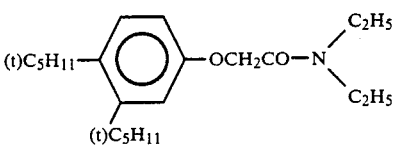
(S-56)
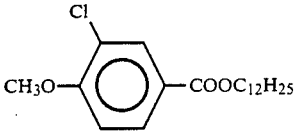
(S-57)
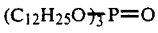
(S-58)
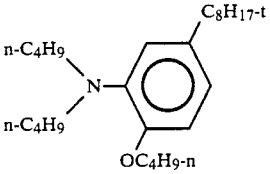
(S-59)
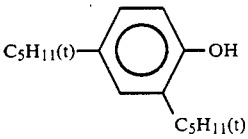
(S-60)
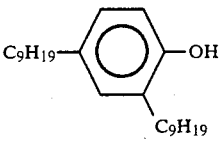
(S-61)
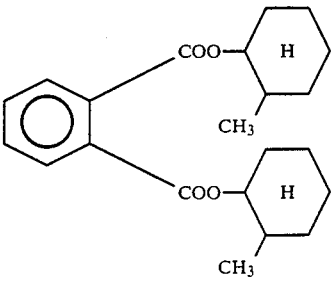

-continued (S-62)

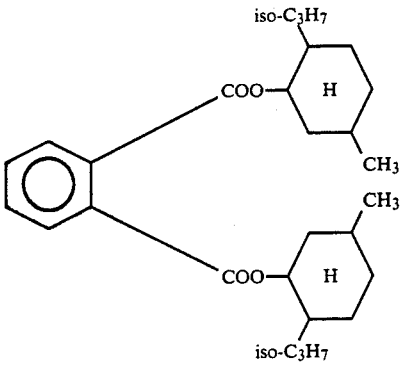

(S-63)

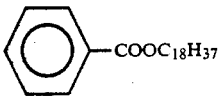

(S-64)

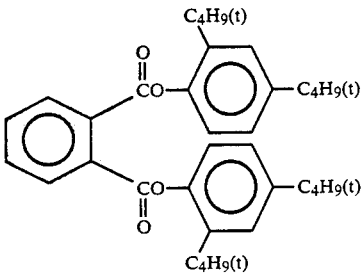

(S-65)

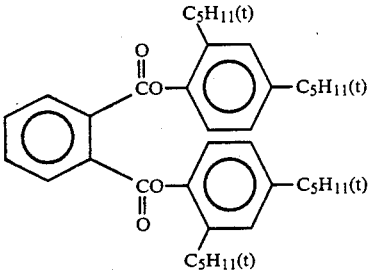

(S-66)

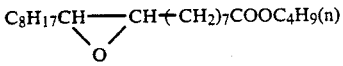

(S-67)

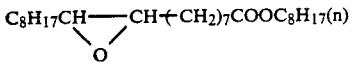

(S-68)

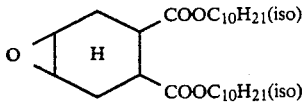

(S-69)

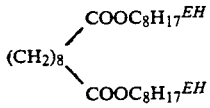

(S-70)

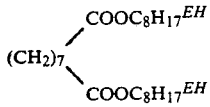

-continued (S-71)

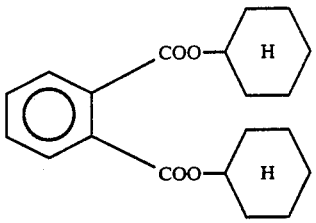

The color photographic light-sensitive material according to the present invention may comprise a support having coated thereon at least one blue-sensitive silver halide emulsion layer, at least one green-sensitive silver halide emulsion layer and at least one red-sensitive silver halide emulsion layer. In the case of conventional color printing papers, the light-sensitive layers are usually provided on a support in the order as described above, but they can also be provided in a different order. Further, an infrared-sensitive silver halide emulsion layer may be employed in place of at least one of the above described emulsion layers. Each of the light-sensitive emulsion layers contains a silver halide emulsion having sensitivity in a respective wavelength region and a so-called color coupler which forms a dye of the complementary color to the light to which the silver halide emulsion is sensitive, that is, yellow, magenta and cyan to blue, green and red, respectively. Thus, color reproduction by a subtractive process can be performed. However, the relationship of the light-sensitive layer and hue of dye formed from the coupler may be varied in a different way from that described above.

Silver halide emulsions used in the present invention are preferably those comprising silver chlorobromide or silver chloride each containing substantially no silver iodide. The terminology "containing substantially no silver iodide" as used herein means that a silver iodide content of the emulsion is not more than 1 mol%, preferably not more than 0.2 mol%.

The halogen composition may be equal or different between individual grains in the emulsion. When an emulsion having an equal halogen composition between individual grains is used, it is easy to uniformly control the properties of the grains. Further, with respect to the distribution of the halogen composition inside, the silver halide emulsion grains, grains having a so-called "uniform structure" wherein the halogen composition is equal at any portion of the grains, grains having a so-called "stratified structure" wherein the halogen composition of the interior (i.e., core) of grain is different from that of the shell (which includes one or more layers) surrounding the core, and grains having a structure wherein portions having different halogen compositions are present in the non-stratified form in the interior or on the surface of grains (i.e., the portion having a different composition being junctioned at an edge, corner or plane of the surface) can be appropriately selected. In order to obtain high sensitivity, it is advantageous to employ any of the two latter type grains rather than the uniform structure grains. They are also preferred in view of their resistance to pressure. In a case wherein silver halide grains have the different structures described above, the boundary of portions having different halogen compositions from each other may be either distinct or vague because of the formation of a mixed crystal due to the composition difference.

Further, grains having an intentionally continuous change in structure may also be employed.

With respect to the halogen composition of a silver chlorobromide emulsion, any silver bromide/silver chloride ratio may be employed. The ratio may be widely varied depending on the purpose, but emulsions having a silver chloride content ratio of 2 mol% or more are preferably employed.

In photographic light-sensitive materials suitable for rapid processing, a so-called "high silver chloride content emulsion" which has a high silver chloride content ratio is preferably used. The silver chloride content ratio in a high silver chloride content emulsion is preferably 90 mol% or more, more preferably 95 mol% or more.

Of such high silver chloride content emulsions, those having a structure wherein a localized phase of silver bromide is present in the interior and/or on the surface of silver halide grains in the stratified form or in the non-stratified form as described above are preferred. With respect to the halogen composition of the localized phase described above it is preferred that the silver bromide content is at least 10 mol, and more preferably exceeding 20 mol%. The localized phase may exist in the interior of the grain, or at the edge, corner or plane of the surface of the grain. One preferred example is a grain wherein epitaxial growth is made at the corner.

On the other hand, for the purpose of minimizing the reduction in sensitivity which occurs when pressure is applied to the photographic light-sensitive material, it is also preferred to use uniform structure type grains, having a narrow distribution of the halogen composition even in a high silver chloride content emulsion having a silver chloride content of 90 mol% or more.

Further, for the purpose of reducing the amount of replenisher for a developing solution, the silver chloride content of a silver halide emulsion may be further increased. In such a case, an almost pure silver chloride is one wherein the silver chloride content is from 98 mol% to 100 mol%.

The average grain size of silver halide grains in the silver halide emulsion used in the present invention (the grain size being defined as a diameter of a circle having the same area as the projected area of the grain and being averaged by number) is preferably from 0.1 $\mu$m to 2 $\mu$m.

Moreover, it is preferred to employ a so-called monodispersed emulsion which has a grain size distribution such that the coefficient of variation (obtained by dividing the standard deviation of the grain size distribution with the average grain size) is not more than 20%, particularly not more than 15%. Further, it is preferred to employ two or more of the above described monodispersed emulsions as a mixture in the same layer or in the form of superimposed layers in order to obtain a wide latitude.

The silver halide grains contained in the photographic emulsion may have a regular crystal shape such as cubic, tetradecahedral, octahedral, etc., or an irregular crystal shape such as spherical, tabular, etc., or may have a composite form of these crystal shapes. Also, a mixture of grains having various crystal shapes may be used. Of these emulsions, those containing the grains having the above described regular crystal shape not more than 50%, preferably not more than 70%, and more preferably not more than 90% are advantageously used in the present invention.

Further, a silver halide emulsion wherein tabular silver halide grains having an average aspect ratio (i.e., the diameter of a corresponding circle/thickness) at least 5, preferably at least 8, accounts for at least 50% of the total projected area of the silver halide grains may be preferably used in the present invention.

The silver chlorobromide emulsion used in the present invention can be prepared in any suitable manner, for example, by the methods as described in P. Glafkides, *Chemie et Physique Photographique,* Paul Montel (1967), G. F. Duffin, *Photographic Emulsion Chemistry,* The Focal Press (1966), and V.L. Zelikman et al., *Making and Coating Photographic Emulsion,* The Focal Press (1964). That is, acid processes, neutral processes, and ammonia processes can all be employed.

Soluble silver salts and soluble halogen salts can be reacted by techniques such as a single jet, process, a double jet process, and a combination thereof. In addition, a method (a so-called "reversal mixing process") in which silver halide grains are formed in the presence of an excess of silver ions can also be employed. As one system of the double jet process, a so-called "controlled double jet process" in which the pAg in a liquid phase where silver halide is formed is maintained at a predetermined level can be employed. This process gives a silver halide emulsion in which the crystal form is regular and the grain size is nearly uniform.

During the step of formation or physical ripening of the silver halide grains of the silver halide emulsion used in the present invention, various kinds of multi-valent metal ion impurities can be introduced. Suitable examples of the compounds include cadmium salts, zinc salts, lead salts, copper salts, thallium salts, salts or complex salts of the Group VIII elements, for example, iron, ruthenium, rhodium palladium, osmium, iridium, and platinum. In particular, the above described Group VIII elements are preferably used. The amount of the compound added can be varied over a wide range depending on the purpose, but it is preferably used in a range from $10^{-9}$ to $10^{-2}$ mol per mol of silver halide.

The silver halide emulsions used in the present invention are usually subjected to chemical sensitization and spectral sensitization.

With respect to the chemical sensitization, a sulfur sensitization method (for example, the use of unstable sulfur compound), a noble metal sensitization method (for example, a gold sensitization method), and a reduction sensitization method are employed individually or in a combination. The compounds preferably used in the chemical sensitization include those as described in JP-A-62-215272, page 18, right lower column to page 22, right upper column.

The emulsions used in the present invention may be of the so-called surface latent image type, wherein a latent image is formed principally on the grain surfaces; or of the so-called internal latent image type wherein the latent image is formed ,principally within the grains.

Yellow couplers, magenta couplers and cyan couplers which form yellow, magenta and cyan colors respectively, on coupling with the oxidized product of a primary aromatic amine based color developing agent are usually used when the invention is applied to color photographic materials.

Cyan, magenta and yellow couplers which are preferably used in the present invention are represented by the general formulae (C-I), (C-II), (M-I), (M-II) and (Y):

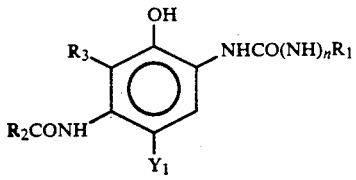

(C-I)

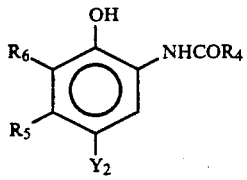

(C-II)

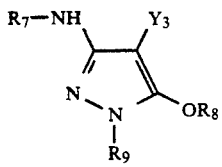

(M-I)

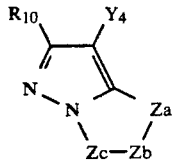

(M-II)

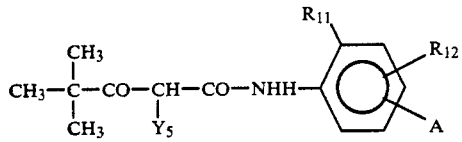

(Y)

In general formulae (C-I) and (C-II), $R_1$, $R_2$ and $R_4$ each represents a substituted or unsubstituted aliphatic, aromatic or heterocyclic group (preferably a 5- t 7-membered ring containing at least one of N, O and S as a hetero atom: the same hereinafter). $R_3$, $R_5$ and $R_6$ each represents a hydrogen atom, halogen atom, aliphatic group, aromatic group or acylamino group (in the present invention an acyl group or an acyl moiety includes an aliphatic and aromatic acyl group or acyl moiety). $R_3$ may represent a nonmetallic atom group which forms a nitrogen-containing 5- or 6-membered ring together with $R_2$. $Y_1$ and $Y_2$ each represents a hydrogen atom or a group capable of being released upon coupling with an oxidation product of a developing agent. The suffix n represents an integer 0 or 1. Each $R_1$, $R_2$, $R_3$ and $R_4$ preferably contains not more than 30 carbon atoms (including carbon atoms in substituent(s)).

The cyan coupler represented by general formula (C-I) or (C-II) will be further described hereinafter.

In general formula (C-I), $R_1$ is preferably an aryl group or heterocyclic group, more preferably aryl group substituted by halogen atom, alkyl group, alkoxy group, aryloxy group, acylamino group, acyl group, carbamoyl group, sulfonamide group, sulfamoyl group, alkyl- or aryl-sulfonyl group, oxycartonyl group or aryl group substituted with a cyano group.

In general formula (C-I), if $R_3$ and $R_2$ do not together form a ring, $R_2$ is preferably a substituted or unsubstituted alkyl or aryl group, preferably a substituted aryloxy-substituted alkyl group, and $R_3$ is preferably a hydrogen atom.

In general formula (C-II), $R_4$ is preferably a substituted or unsubstituted alkyl or aryl group, preferably a substituted aryloxy-substituted alkyl group.

In general formula (C-II), $R_5$ is preferably a $C_{2-15}$ alkyl group and a substituted methyl group containing 1 or more carbon atoms. Preferred examples of such substituents include arylthio group, alkylthio group, acylamino group, aryloxy group, and alkyloxy group.

In general formula (C-II), $R_5$ is more preferably $C_{2-15}$ alkyl group, particularly $C_{2-4}$ alkyl group.

In general formula (C-II), $R_5$ is preferably an aliphatic group such as methyl group, ethyl group, propyl group, butyl group, pentadecyl group, tert-butyl group, cyclohexyl group, cyclohexylmethyl group, phenylthiomethyl group, dodecyloxyphenyl&hiomethyl group, butanamidemethyl group and methoxymethyl group.

In general formula (C-II), $R_6$ is preferably a hydrogen atom or halogen atom, particularly chlorine atom or fluorine atom. In general formulae (C-I) and (C-II), $Y_1$ and $Y_2$ each is preferably a hydrogen atom, halogen atom, alkoxy group, aryloxy group, acyloxy group or sulfonamide group.

These cyan couplers may be in the form of a polymer.

In formula (M-I), $R_7$ and $R_9$ each represents an aryl group; $R_8$ represents a hydrogen atom, an aliphatic or aromatic acyl group or an aliphatic or aromatic sulfonyl group; and $Y_3$ represents a hydrogen atom or a releasing group. $R_7$, $R_8$, and $R_9$ each preferably contains carbon atoms of not more than 40 (including carbon atoms in a substitutent(s)).

The aryl group represented by $R_7$ or $R_9$ (preferably a phenyl group) may be substituted with one or more substituents which are selected from the substituents described with respect to $R_1$. When two or more substituents are present, they may be the same or different. $R_8$ is preferably a hydrogen atom, an aliphatic acyl group or an aliphatic sulfonyl group, and more preferably a hydrogen atom. $Y_3$ is preferably a releasing group which is released at any of a sulfur atom, an oxygen atom or a nitrogen atom, and more preferably a releasing group of a sulfur atom releasing type as described, for example, in U.S. Pat. No. 4,351,897 and International Laid Open No. WO 88/04795.

In the general formula (M-II), $R_{10}$ represents a hydrogen atom or a substituent; $Y_4$ represents a hydrogen atom or a releasing group, preferably a halogen atom or an arylthio group; Za, Zb and Zc each represents a methine group, a substituted mettine group, =N— or —NH—, wherein one of the Za-Zb bond and the Zb-Zc bond is a double bond and the other is a single bond; when the Zb-Zc bond is a carbon-carbon double bond, the Zb-Zc bond may be a part of a condensed aromatic ring; $R_{10}$ or $Y_4$ may also form a polymer including a dimer or more; and when Za, Zb or Zc is a substituted methine group, the substituted methine group may form a polymer including a dimer or more.

Examples for the substituent represented by $R_{10}$, the substituent for the azole ring, etc., may be those which are disclosed in U.S. Pat. No. 4,540,654, column 2, line 41 to column 8, line 27.

Of the pyrazoloazole type couplers which are represented by formula (M-II), imidazo[1,2-b]pyrazoles as described in U.S. Pat. No. 4,500,630 are preferred and pyrazolo[1,5-b][1,2,4]triazoles as described in U.S. Pat. No. 4,540,654 are particularly preferred in view of the less yellow subsidiary adsorption and light fastness of dyes formed therefrom.

Further, pyrazolotriazole couplers having a branched alkyl group directly connected to the 2, 3 or 6 position of the pyrazolotriazole ring as described in JP-A-61-65245, pyrazoloazole couplers having a sulfonamido group in their molecules as described in JP-A-61-65246, pyrazoloazole couplers having an alkoxyphenylsulfonamido ballast group as described in JP-A-61-147254, and pyrazolotriazole couplers having an alkoxy group or an aryloxy group at the 6 position thereof as described in European Patent (OPI) Nos. 226,849 and 294,785 are also preferably employed.

The above described magenta couplers may be in a form of a polymer.

In the general formula (Y), $R_{11}$ represents a halogen atom, an alkoxy group, a trifluoromethyl group or an aryl group; $R_{12}$ represents a hydrogen atom, a halogen atom or an alkoxy group; A represents $—NHCOR_{13}$, $—NHSO_2R_{13}$, $—SO_2NHR_{13}$, $—COOR_{13}$ or $$—SO_2\underset{\underset{R_{14}}{|}}{N}—R_{13}$$

(wherein $R_{13}$ and $R_{14}$ each represents an alkyl group, an aryl group or an acyl group); and $Y_5$ represents a releasing group.

The group represented by $R_{12}$, $R_{13}$ or $R_{14}$ may be substituted with one or more substituents which are selected from the substituents described with respect to $R_1$. The releasing group represented by $Y_5$ is preferably a releasing group which is released at any of an oxygen atom or a nitrogen atom, and more preferably a releasing group of a nitrogen atom releasing type.

The above-described yellow couplers may be in the form of a polymer.

Specific examples of couplers represented by the general formulae (C-I), (C-II), (M-I), (M-II) and (Y) will be set forth below, but the present invention should not be construed as being limited thereto.

(C-1)

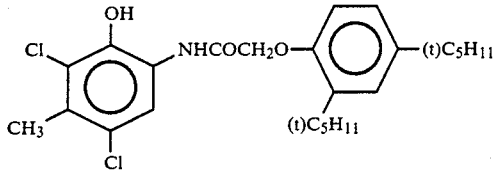

(C-2)

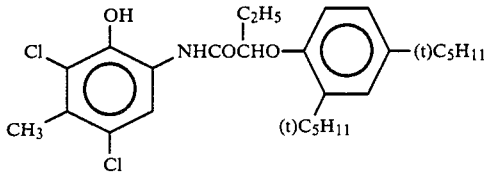

(C-3)

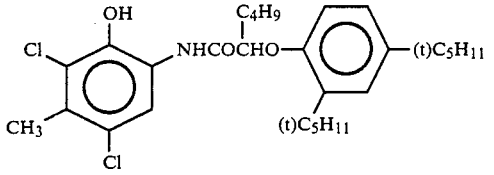

(C-4)

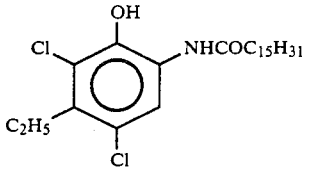

(C-5)

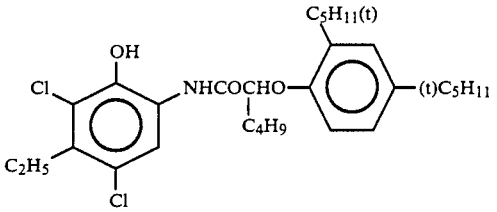

(C-6)

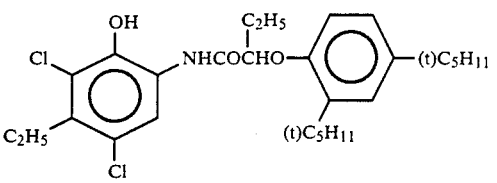

-continued
(C-7)
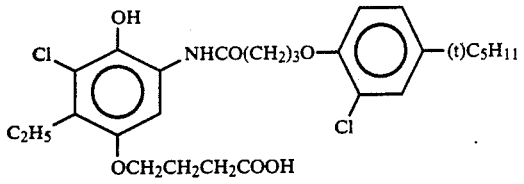
(C-8)
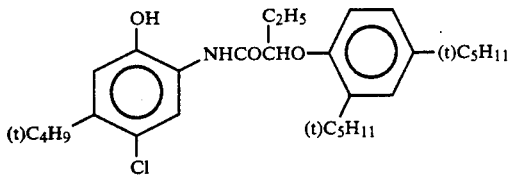
(C-9)
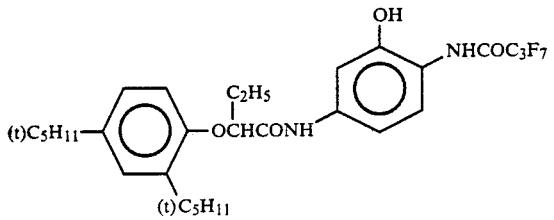
(C-10)
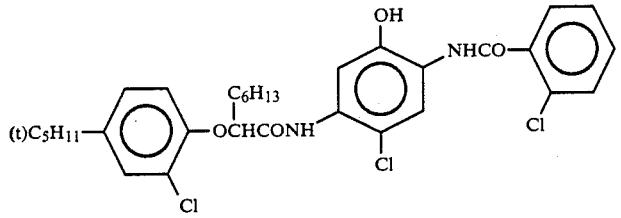
(C-11)
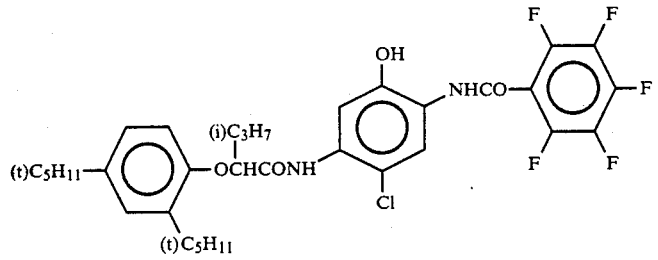
(C-12)
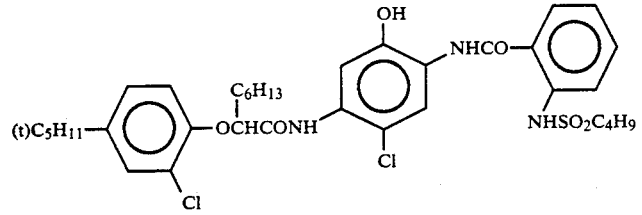
(C-13)
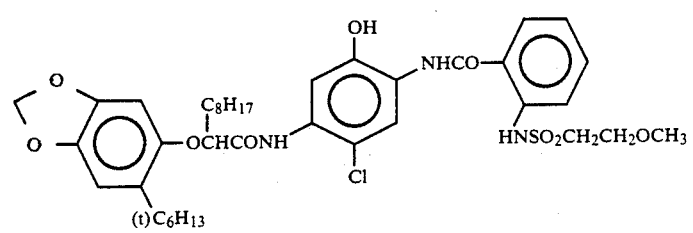

-continued
(C-14)
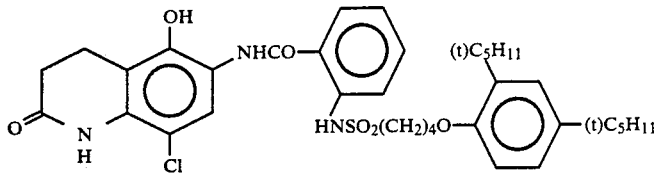
(C-15)
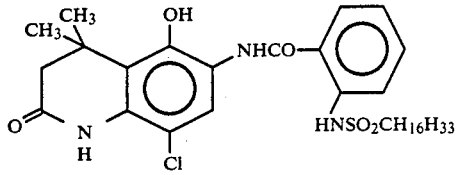
(C-16)
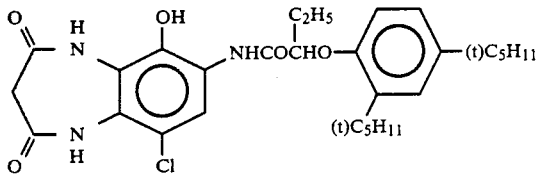
(C-17)
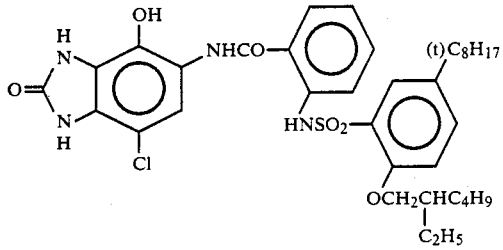
(C-18)
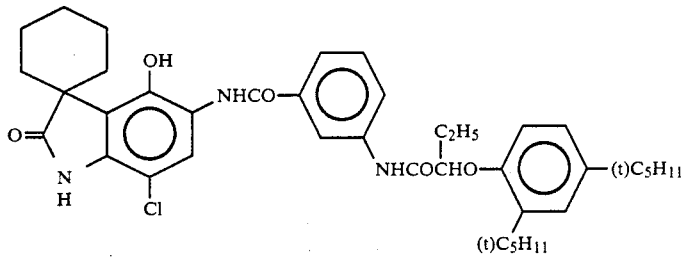
(C-19)
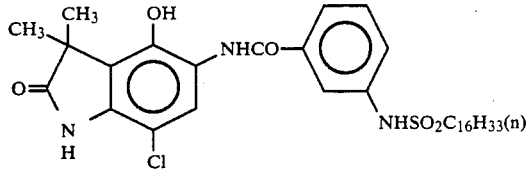
(C-20)
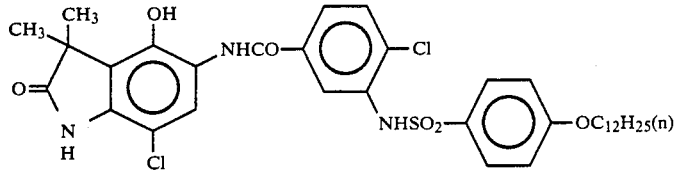
(C-21)
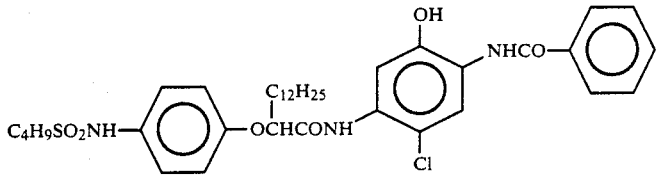

-continued
(C-22)
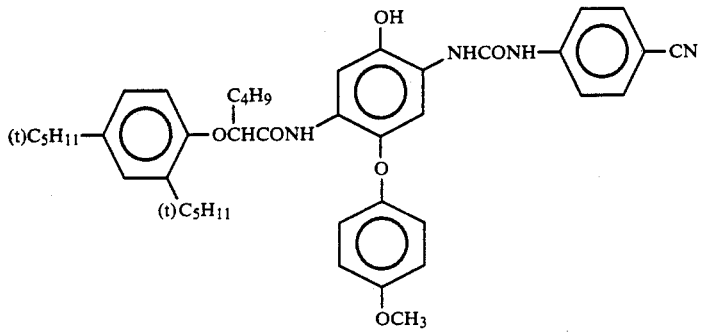
(M-1)
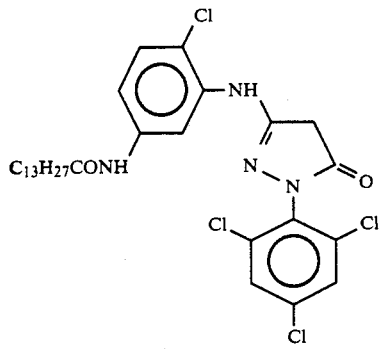
(M-2)
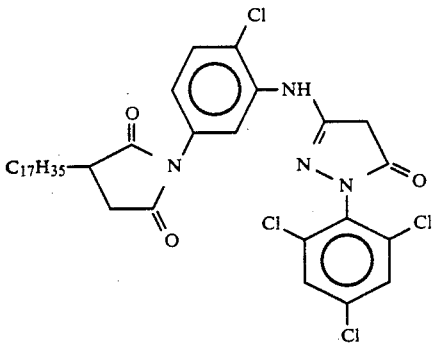
(M-3)
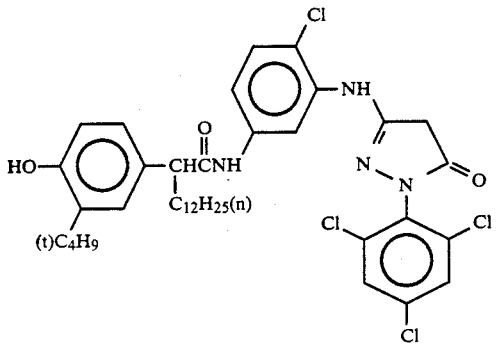

-continued
(M-4)
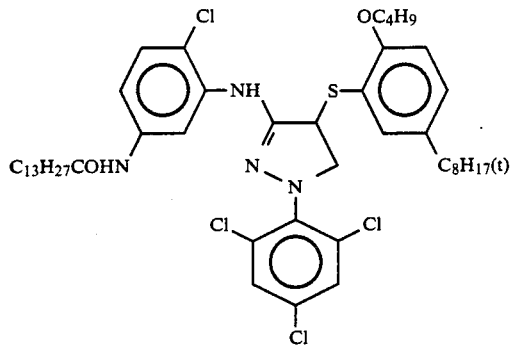
(M-5)
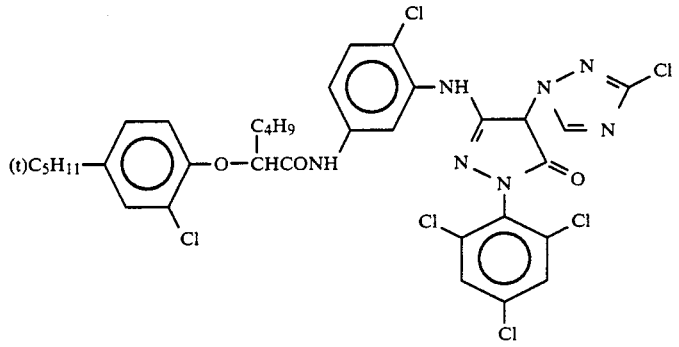
(M-6)
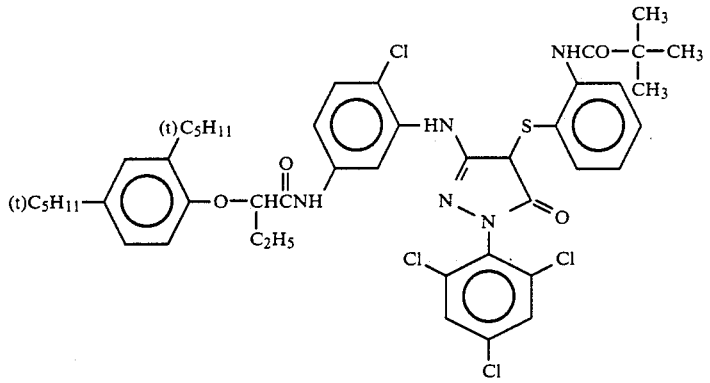
(M-7)
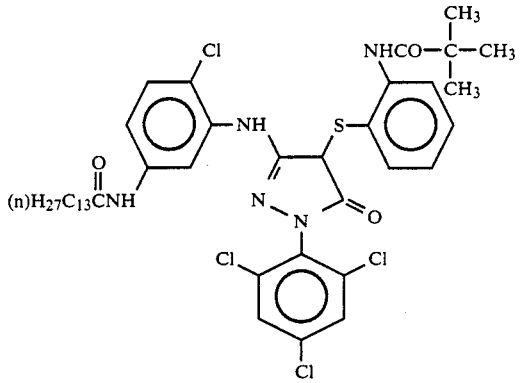

-continued
(M-8)
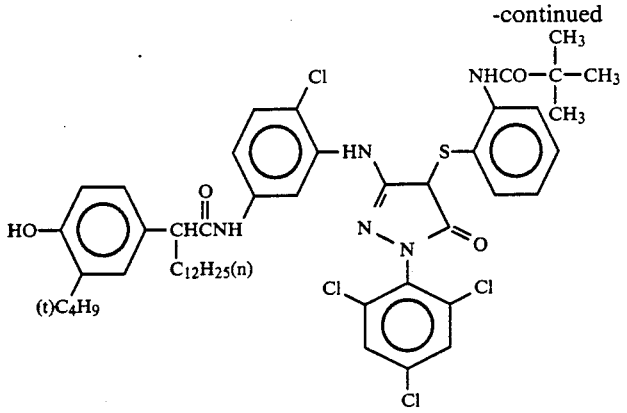

| Compound | $R_{10}$ | $R_{15}$ | $Y_4$ |
|---|---|---|---|
| | | 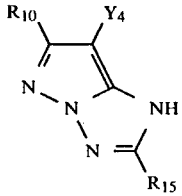 | |
| M-9 | $CH_3$— | 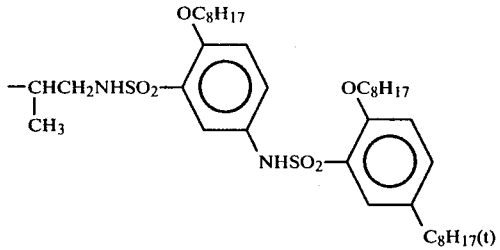 | Cl |
| M-10 | As above | 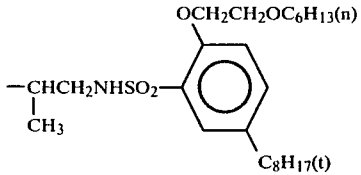 | As above |
| M-11 | $(CH_3)_3C$— | 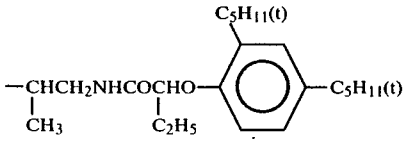 | 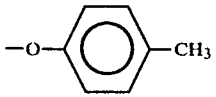 |
| M-12 | 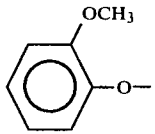 | 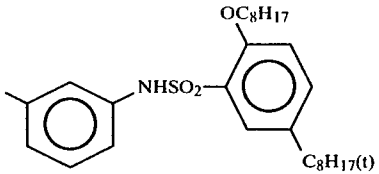 | 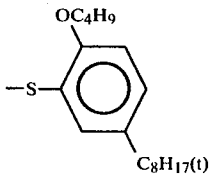 |

-continued
| Compound | $R_{10}$ | $R_{15}$ | $Y_4$ |
|---|---|---|---|
| M-13 | $CH_3$— | 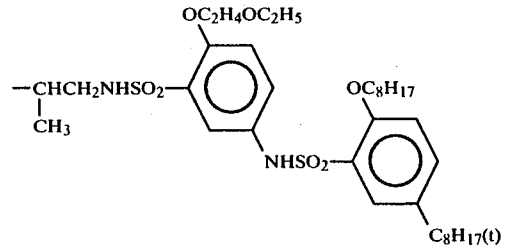 | Cl |
| M-14 | As above | 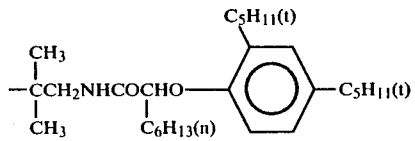 | As above |
| M-15 | $CH_3$— | 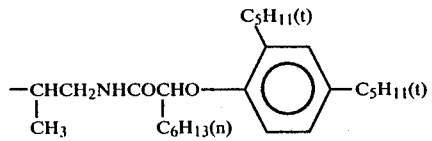 | Cl |
| M-16 | As above | 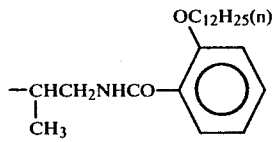 | As above |
| M-17 | As above | 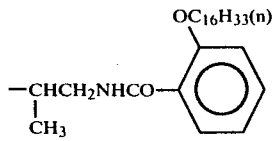 | As above |

-continued
| Compound | $R_{10}$ | $R_{15}$ | $Y_4$ |
|---|---|---|---|
| M-18 | 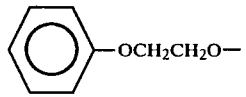 | 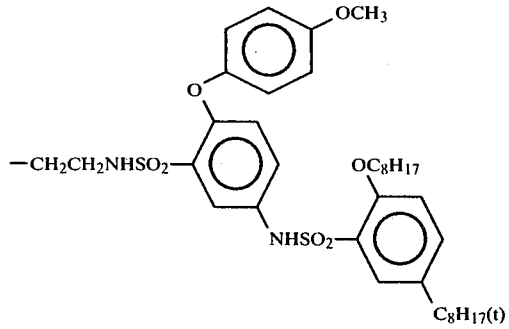 | 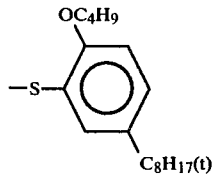 |
| M-19 | $CH_3CH_2O-$ | As above | As above |
| M-20 | 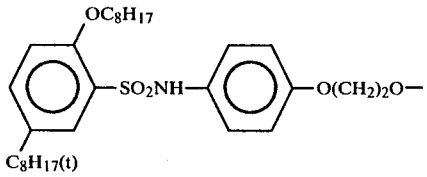 | 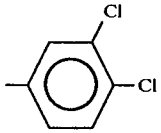 | 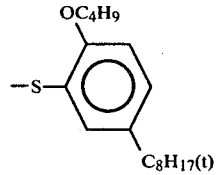 |
| M-21 | 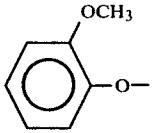 | 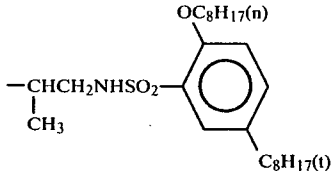 | Cl |
| | 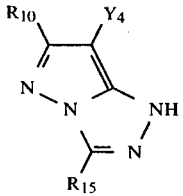 | | |
| M-22 | $CH_3-$ | 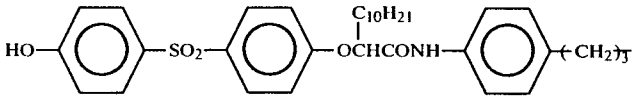 | Cl |

-continued

| Compound | $R_{10}$ | $R_{15}$ | $Y_4$ |
|---|---|---|---|
| M-23 | As above | $(n)C_6H_{13}$ \ $CHCH_2SO_2\text{-}(CH_2)_2\text{-}$ / $(n)C_8H_{17}$ | As above |
| M-24 | $CH_3$ \ $CH-$ / $CH_3$ | $OC_4H_9$; $-SO_2\text{-}(CH_2)_3\text{-}$; $C_8H_{17}(t)$ | As above |
| M-25 | $\text{-}(CH(COOCH_2CH_2OCH_3)-CH_2)_{50}\text{-}(CH_2-C(CH_3)(CONH-))_{50}\text{-}$ | $CH_3-CH(CH_2NHSO_2CH_3)-$ | As above |
| | (Suffixes of parenthesis show weight ratio) | | |
| M-26 | $-O-$ | $OC_8H_{17}$; $\text{-}(CH_2)_2NHSO_2-$; $C_8H_{17}(t)$ | Cl |
| M-27 | $CH_3-$ | $CH_3$; $CH_3$; $CH_3$; $NHCOCHO-$ ($(n)C_{10}H_{21}$); $-SO_2-$; $-OCH_2-$ | As above |

-continued
| Compound | $R_{10}$ | $R_{15}$ | $Y_4$ |
|---|---|---|---|
| M-28 | $(CH_3)_3C-$ | 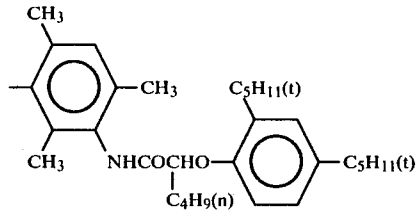 | As above |
| M-29 | 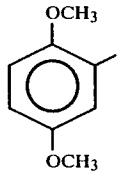 | 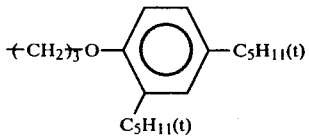 | Cl |
| M-30 | $CH_3$ | $-CH(C_2H_5)-N(C_{18}H_{37})COCH_2CH_2COOH$ | As above |

(Y-1)
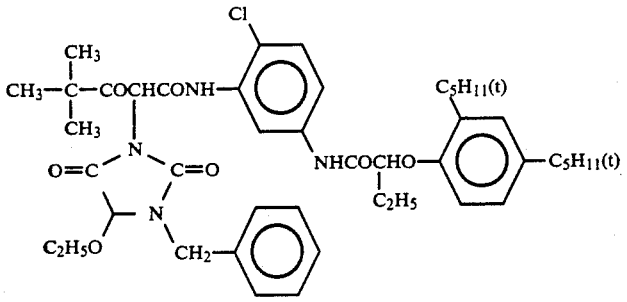
(Y-2)
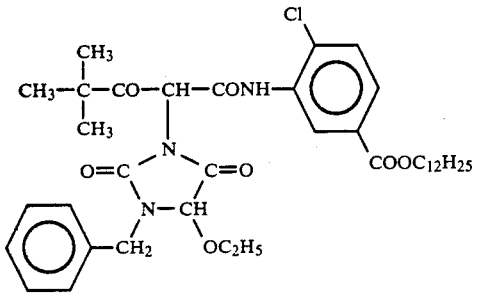
(Y-3)
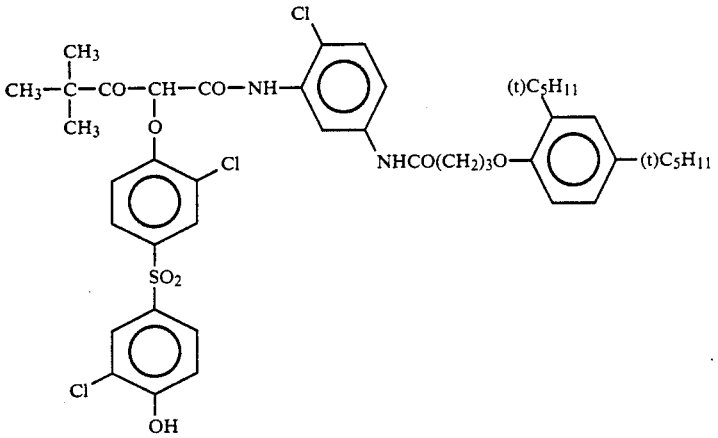
(Y-4)
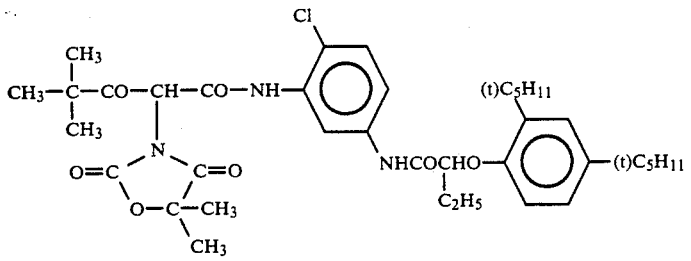
(Y-5)
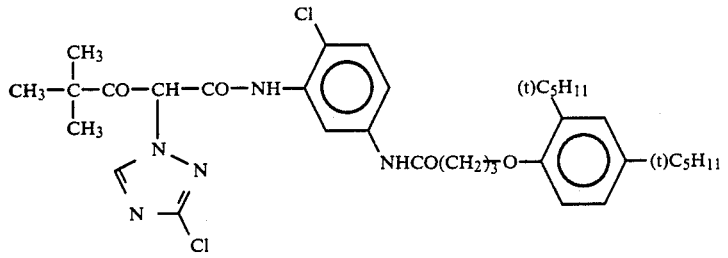

-continued (Y-6)

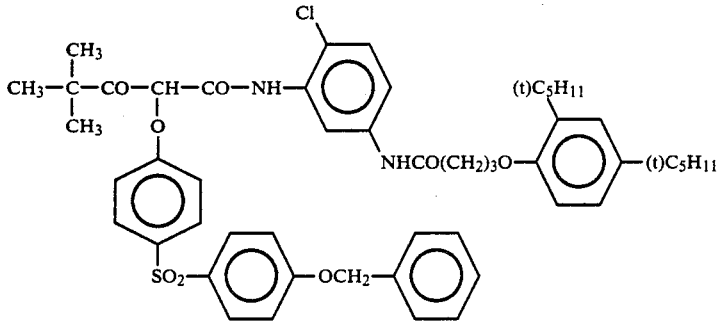

(Y-7)

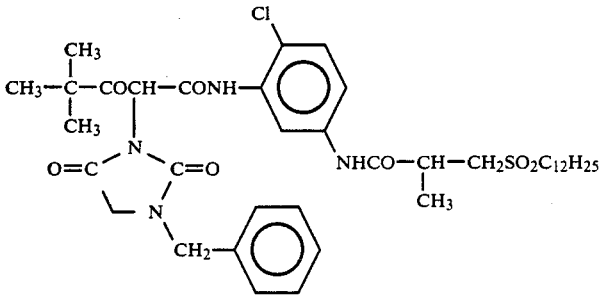

(Y-8)

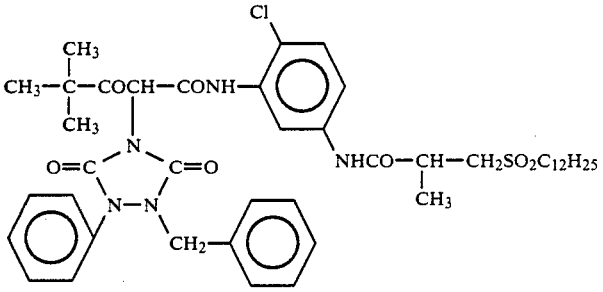

(Y-9)

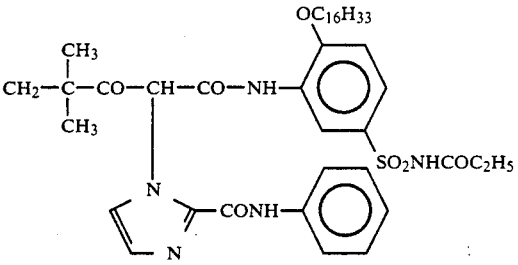

The aforementioned couplers represented by general formulae (C-I) to (Y) are normally included in the silver halide emulsion layers which form the photo-sensitive layer in an amount of from 0.1 to 1.0 mol, preferably of from 0.1 to 0.5 mol, per mol of silver halide.

In the present invention, the above-described couplers, may be added to light-sensitive silver halide emulsion layers by applying various known techniques. Usually, they can be added according to an oil-droplet-in-water dispersion method known as an oil protected process. For example, couplers are first dissolved in a solvent, and then emulsified and dispersed in a gelatin aqueous solution containing a surface active agent. Alternatively, water or a gelatin aqueous solution may be added to a coupler solution containing a surface active agent, followed by phase inversion to obtain an oil-droplet-in-water dispersion. Further, alkali-soluble couplers may also be dispersed according to a so-called Fischer's dispersion process. The coupler dispersion may be subjected to distillation, noodle washing, ultrafiltration, or the like to remove an organic solvent having a low boiling point and then mixed with a photographic emulsion.

As the dispersion medium of the couplers, an organic solvent having a high boiling point which has a dielectric constant of 2 to 20 (at 25° C.) and a refractive index of 1.5 to 1.7 (at 25° C.) and/or a water-insoluble polymer compound is preferably employed.

Preferred examples of the organic solvent having a high boiling point used in the present invention include those represented by the following general formula (A), (B), (C), (D) or (E):

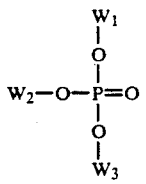

(A)

$W_1-COO-W_2$ (B)

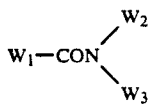

(C)

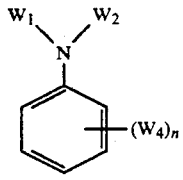

(D)

$W_1-O-W_2$ (E)

wherein $W_1$, $W_2$ and $W_3$ each represents a substituted or unsubstituted alkyl group, a substituted or unsubstituted cycloalkyl group, a substituted or unsubstituted alkenyl group, a substituted or unsubstituted aryl group or a substituted or unsubstituted heterocyclic group; $W_4$ represents $W_1$, —O—$W_1$ or —S—$W_1$; n represents an integer from 1 to 5, and when n is two or more, two or more $W_4$'s may be the same or different. In addition, $W_1$ and $W_2$ in formula (E) may form a condensed ring.

In addition to the solvents represented by formulae (A) to (E), any compound which has a melting point of 100° C. or lower and a boiling point of 140° C. or higher and which is immiscible with water and a good solvent for the coupler may be utilized as the high boiling point solvent in the present invention. The melting point of the organic solvent having a high boiling point is preferably not more than 80° C. The boiling point of the organic solvent having a high boiling point is preferably not less than 160° C., more preferably not less than 170° C.

Organic solvents having a high boiling point are described in detail in JP-A-62-215272, page 137, right lower column to page 144, right upper column.

Further, these couplers can be emulsified and dispersed in an aqueous solution of a hydrophilic colloid by loading them into a loadable latex polymer (such as those described in U.S. Pat. No. 4,203,716) in the presence of or in the absence of the above described organic solvent having a high boiling point, or dissolving them in a water-insoluble and organic solvent-soluble polymer.

Suitable examples of the polymers include homopolymers and copolymers as described in International Laid Open No. WO 88/00723, pages 12 to 30. In particular, acrylamide polymers are preferably used in view of improved color image stability.

The color photographic light-sensitive material according to the present invention ray also contain a hydroquinone derivative, an aminophenol derivative, a gallic acid derivative, or an ascorbic acid derivative, as a color fog preventing agent.

In the color photographic light-sensitive material according to the present invention, various color fading preventing agents can be employed. More specifically, representative examples of organic color fading preventing agents for cyan, magenta and/or yellow images include hindered phenols (for example, hydroquinones, 6-hydroxychromans, 5-hydroxycoumarans, spirochromans, p-alkoxyphenols, or bispherols), gallic acid derivatives, methylenedioxybenzenes, aminophenols, hindered amines, or ether or ester derivatives thereof derived from each of these compounds by sililation or alkylation of the phenolic hydroxy group thereof. Further, metal complexes representatively illustrated by (bissalicylaldoxymate) nickel complex and (bis-N,N-dialkyldithiocarbamate) nickel complexes may be employed.

Specific examples of the organic color fading preventing agents are described in the following patents or patent applications.

Hydroquinones: U.S. Pat. Nos. 2,360,290, 2,418,613, 2,700,453, 2,701,197, 2,728,659, 2,732,300, 2,735,765, 3,982,944 and 4,430,425, British Patent 1,363,921, U.S. Pat. Nos 2,710,801 and 2,816,028; 6-hydroxychromanes, 5-hydroxycoumarans and spirochromanes: U.S. Pat. Nos. 3,432,300, 3,573,050, 3,574,627, 3,698,909 and 3,764,337, JP-A-52-152225; spiroindanes: U.S. Pat. No. 4,360,589; p-alkoxyphenols: U.S. Pat. Nos. 2,735,765, British Patent 2,066,975, JP-A-59-10539, JP-B-57-19765; hindered phenols: U.S. Pat. No. 3,700,455, JP-A-52-72224, U.S. Pat. No. 4,228,235, JP-B-52-6623; gallic acid derivatives, methyleneiioxybenzenes and aminophenols: U.S. Pat. Nos. 3,457,079 and 4,332,886 JP-B-56-21144; hindered amines: U.S. Pat. Nos. 3,336,135 and 4,268,593, British Patents 1,326,889, 1,354,313 and 1,410,846, JP-B-51-1420, JP-A-58-114036, JP-A-59-53846, JP-A-59-78344.

Further, specific examples of the metal complexes are described in U.S. Pat. Nos. 4,050,938 and 4,241,155, and British Patent 2,027,731(A).

The color fading preventing agent is coemulsified with the corresponding color coupler in an amount of from 5 to 100% by weight of the color coupler and incorporated into the light-sensitive layer to achieve the effects thereof.

In order to prevent the degradation of the cyan dye image due to heat and particularly due to light, an ultraviolet light absorbing agent is introduced into a cyan color forming layer and/or both layers adjacent to the cyan color forming layer.

Suitable examples of the ultraviolet light absorbing agents used include aryl group-substituted benzotriazole compounds (for example, those as described in U.S. Pat. No. 3,533,794), 4-thiazolidone compounds (for example, those as described in U.S. Pat. Nos. 3,314,794 and 3,352,681), benzophenone compounds (for example, those as described in JP-A-46-2784), cinnamic acid ester compounds (for example, those as described in U.S. Pat. Nos. 3,705,805 and 3,707,395), butadiene compounds (for example, those as described in U.S. Pat. No. 4,045,229), and benzoxidol compounds such as those described, for example, in U.S. Pat. Nos. 3,406,070, 3,677,672 and 4,271,307. Furthermore, ultraviolet light absorptive couplers (for example, α-naphtholic cyan dye forming couplers) or ultraviolet light absorptive polymers may be used as ultraviolet light absorbing agents. These ultraviolet light absorbing agents may be mordanted in a specific layer.

Among these ultraviolet light absorbing agents, the aryl group-substituted benzotriazole compounds described above are preferred.

In accordance with the present invention, it is preferred to employ the compounds as described below together with the above described couplers, particularly the pyrazoloazole couplers. More specifically, a compound (F) which is capable of forming a chemical bond with the aromatic amine developing agent remaining after color development to give a chemically inactive and substantially colorless compound and/or a compound (G) which is capable of forming a chemical bond with the oxidation product of the aromatic amine developing agent remaining after color development to give a chemically inactive and substantially colorless compound are preferably employed in order to prevent the occurrence of stain and other undesirable side-effects due to the formation of colored dye upon a reaction of the color developing agent or oxidation product thereof which remains in the photographic layer with the coupler during preservation of the photographic material after processing. The compounds (F) and (G) may be employed individually or in combination.

Among the compounds (F), those capable of reacting at a second order reaction rate constant $k_2$ (in trioctyl phosphate at 80° C.) with p-anisidine of from 1.0 liter/mol·sec. to $1\times10^{-5}$ liter/mol·sec. are preferred. The second order reaction rate constant can be measured by a method such as that described in JP-A-63-158545.

When the constant $k_2$ is larger than the upper limit of this range, the compounds per se are unstable and may apt to react with gelatin or water to decompose. On the other hand, when the constant $k_2$ is smaller than the lower limit of the above described range, the reaction rate in the reaction with the remaining aromatic amine developing agent is low, and as a result, the degree of prevention of the side-effect due to the remaining aromatic amine developing agent, tends to be reduced.

Of the Compounds (F), more preferred are those represented by the following general formula (FI) or (FII):

$$R_1-(A)_n-X \quad \text{(FI)}$$

$$R_2-\underset{\underset{B}{|}}{C}=Y \quad \text{(FII)}$$

wherein $R_1$ and $R_2$ each represents an aliphatic group, an aromatic group or a heterocyclic group; n represents 0 or 1; A represents a group capable of reacting with an aromatic amine developing agent to form a chemical bond; X represents a group capable of being released upon the reaction with an aromatic amine developing agent; B represents a hydrogen atom, an aliphatic group, an aromatic group, a heterocyclic group, an acyl group or a sulfonyl group; Y represents a group capable of accelerating the addition of an aromatic amine developing agent to the compound represented by the general formula (FII); or $R_1$ and X, or Y and $R_2$ or B may combine with each other to form a cyclic structure.

A substitution reaction and an addition reaction are typical reactions for forming a chemical bond with the remaining aromatic amine developing agent.

Specific preferred examples of the compounds represented by formulae (FI) or (FII) are described, for example, in JP-A-63-158545, JP-A-62-283338, European Patent (OPI) Nos. 298,321 and 277,589.

On the other hand, of the Compounds (G) those more preferred are represented by the following general formula (GI):

$$R-Z \quad \text{(GI)}$$

wherein R represents an aliphatic group, an aromatic group or a heterocyclic group; and Z represents a nucleophilic group or a group capable of being decomposed in the photographic material to release a nucleophilic group.

Of the compounds represented by the general formula (GI), those wherein Z is a group having a Pearson's nucleophilic $^{n}CH_3I$ value of at least 5 (R. G. Pearson et al., *J. Am. Chem. Soc.*, Vol. 90, page 319 (1968)) or a group derived therefrom are preferred.

Specific preferred examples of the compounds represented by the general formula (GI) are described, for example, in European Patent (OPI) No. 255,722, JP-A-62-143048, JP-A-62-229145, Japanese Patent Application No. 63-136724 and JP-A-1-57259, European Patent (OPI) Nos. 298,321 and 277,589.

Further, combinations of Compound (G) and Compound (F) are described in detail in European Patent (OPI) No. 277,589.

The photographic light-sensitive material according to the present invention may contain water-soluble dyes or dyes which become water-soluble at the time of photographic processing as filter dyes or for irradiation or halation prevention or other various purposes in the hydrophilic colloid layers. Examples of such dyes include oxonol dyes, hemioxonol dyes, styryl dyes, merocyanine dyes, cyanine dyes, and azo dyes. Of these dyes, oxonol dyes, hemioxonol dyes, and merocyanine dyes are most useful.

As binders or protective colloids which can be used for the emulsion layers of the color photographic light-sensitive material according to the present invention, gelatin is preferably used, but other hydrophilic colloids can be used alone or together with gelatin.

As gelatin, lime-treated gelatin or acid-treated gelatin can be used in the present invention. Details of the production of gelatin are described in Arther Weiss, *The Macromolecular Chemistry of Gelatin*, published by Academic Press, 1964.

As the support those supports conventionally employed in photographic light-sensitive materials, for example, transparent films such as cellulose nitrate films and polyethylene terephthalate films, or reflective supports can be used. For the purpose of the present invention, reflective supports are preferably employed.

The term "reflective support" refers to those supports having an increased reflection property for the purpose of rendering dye images formed in the silver halide emulsion layer clear. Examples of reflective supports include supports having coated thereon a hydrophobic resin containing a light reflective substance such as titanium oxide, zinc oxide, calcium carbonate, or calcium sulfate dispersed therein and supports composed of a hydrophobic resin containing a light reflective substance dispersed therein. More specifically, they include baryta coated paper; polyethylene coated paper; polypropylene type synthetic paper; transparent supports, for example, a glass plate, a polyester film such as a polyethylene terephthalate film, a cellulose triacetate film or a cellulose nitrate film, a polyamide film, a polycarbonate film, a polystyrene film, or a vinyl chloride resin, having a reflective layer or having incorporated therein a reflective substance.

Other examples of reflective support which can be used are supports having a metal surface of mirror reflectivity or secondary diffuse reflectivity. The metal surface preferably has a spectral reflectance of 0.5 or more in the visible wavelength range. The metal surface is preferably produced by roughening or imparting diffusion reflectivity using metal powders. Suitable examples of metals include aluminum, tin, silver, magnesium or an alloy thereof. The metal surface includes a metal plate, a metal foil or a metal thin layer obtained by rolling, vacuum evaporation or plating. Among them, a metal surface obtained by vacuum evaporation of metal on other substrate is preferably employed.

On the metal surface it is preferred to provide a water-proof resin layer, particularly a thermoplastic resin layer. On the opposite side of the support to the metal surface, an antistatic layer is preferably provided. Details of these supports are described, for example, in JP-A-61-210346, JP-A-63-24247, JP-A-63-24251 and JP-A-63-24255.

A suitable support can be appropriately selected depending on the purpose of use.

As the light reflective substance, white pigments thoroughly kneaded in the presence of a surface active agent are employed, and pigments the surface of which was treated with a divalent, trivalent or tetravalent alcohol are preferably used.

The occupied area ratio (%) per a definite unit area of fine white pigment particles can be determined in the following typical manner. Specifically, the area observed is divided into the unit area of 6 $\mu m \times 6 \mu m$ adjacent to each other, and the occupied area ratio (Ri) (%) of the fine particle projected on the unit area is measured. The coefficient of variation of the occupied area ratio (%) can be obtained by a ratio of S/R wherein S is a standard deviation of Ri and R is an average value of Ri. A number (n) of the unit are subject is preferably 6 or more. Thus, the coefficient of variation (S/R) is obtained by the following equation:

$$\sqrt{\frac{\sum_{i=1}^{n} (Ri - R)^2}{n-1}} \Big/ \frac{\sum_{i=1}^{n} Ri}{n}$$

In the present invention, the coefficient of variation of the occupied area ratio (%) of fine pigment particles is preferably not more than 0.15, particularly preferably not more than 0.12. When the value is not more than 0.08, the dispersibility of particles can be designated as substantially uniform.

A color developing solution which can be used in development processing of the color photographic light-sensitive material is an alkaline aqueous solution preferably containing an aromatic primary amine type color developing agent as a main component. As the color developing agent, while an aminophenol type compound is useful, a p-phenylenediamine type compound is preferably employed. Typical examples of the p-phenylenedimmine type compounds include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, or sulfate, hydrochloride or p-toluenesulfonate thereof.

Two or more kinds of color developing agents may be employed in a combination thereof, depending on the purpose.

The color developing solution can ordinarily contain pH buffering agents, such as carbonates or phosphates of alkali metals; and development inhibitors or anti-fogging agents such as bromides, iodides, benzimidazoles, benzothiazoles, or mercapto compounds. Further, if necessary, the color developing solution may contain various preservatives such as hydroxylamine, diethylhydroxylamine, sulfites, hydrazines, for example, N,N-biscarboxymethylhydrazine, phenylsemicarbazides, triethanolamine, or catechol sulfonic acids; organic solvents such as ethyleneglycol, or diethylene glycol; development accelerators such as benzyl alcohol, polyethylene glycol, quaternary ammonium salts, or amines; dye forming couplers; competing couplers; auxiliary developing agents such as 1-phenyl-3-pyrazolidone; viscosity imparting agents; and various chelating agents representatively illustrated by aminopolycarboxylic acids, aminopolyphosphonic acids, alkylphosphonic acids, or phosphonocarboxylic acids. Representative examples of the chelating agents include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid), and salts thereof.

In case of conducting reversal processing, color development is usually conducted after black-and-white development and reversal processing. In a black-and-white developing solution, known black-and-white developing agents, for example, dihydroxybenzenes such as hydroquinone, 3-pyrazolidones such as 1-phenyl-3-pyrazolidone, or aminophenols such as N-methyl-p-aminophenol may be employed individually or in a combination.

The pH of the color developing solution or the black-and-white developing solution is usually in a range from 9 to 12. Further, an amount of replenishment for the developing solution can be varied depending on color photographic light-sensitive materials to be processed, but is generally not more than 3 liters per square meter of the photographic light-sensitive material. The amount of replenishment can be reduced to not more than 500 ml by decreasing a bromide ion concentration in the replenisher. In the case of reducing the amount of replenishment, it is preferred to prevent evaporation and aerial oxidation of the processing solution by means of reducing an area of a processing tank which is contact with the air.

The contact area of a photographic processing solution with the air in the processing tank can be represented by an opening rate as defined below $$\text{Opening Rate} = \frac{\text{Contact area of processing solution with the air (cm}^2\text{)}}{\text{Volume of processing solution (cm}^3\text{)}}$$

The opening rate described above is preferably not more than 0.1, more preferably from 0.001 to 0.05. Means for reducing the opening rate include a method using a movable cover as described in Japanese Patent Application No. 62-241342, a slit development processing method as described in JP-A-63-216050, in addition to a method wherein a shelter such as a floating cover is provided on the surface of a photographic processing solution in a processing tank.

It is preferred to apply the reduction of the opening rate not only to steps of color development and black and white development but also to all other subsequent steps, for example, bleaching, bleach-fixing, fixing, water washing and stabilizing. Further, the amount of replenishment can be reduced by using a means which restrain accumulation of bromide ions in the developing solution.

A processing time for the color development processing is usually selected in a range from 2 minutes to 5 minutes. However, it is possible to reduce the processing time by performing the color development at a high temperature and a high pH using a high concentration of the color developing agent.

The use of a development bath which is essentially benzyl alcohol free is preferred in the execution of the present invention. Here, the term "essentially benzyl alcohol free" signifies that the benzyl alcohol concentration is preferably not more than 2 ml/liter, more preferably not more than 0.5 ml/liter, and most preferably that the bath does not contain benzyl alcohol at all.

The preferred development solution are essentially sulfite ion free. Sulfite ion functions as a developing agent preservative but, at the same time, has a silver halide dissolving action and reacts with the oxidized product of the developing agent. This reduces the dye forming efficiency. These actions are believed to be one of the reasons for increased fluctuation in photographic characteristics which arises in continuous processing. Here, the term "essentially sulfite free" signifies that the sulfite ion concentration is preferably not more than $3.0\times10^{-3}$ mol/liter, and most preferably, the development solution contains no sulfite ion at all.

The color developed photographic emulsion layer is generally subjected to a bleaching process. The bleaching process can be carried out at the same time as the fixing process (bleach-fix process), or it may be carried out independently. Moreover, it may be appropriately practiced depending on the purpose to process using a continuous two tank bleach-fixing bath, to carry out fix processing before bleach-fix processing, or to conduct bleach processing after bleach-fix processing.

Examples of bleaching agents which can be employed in the bleach processing or bleach-fix processing include compounds of a multivalent metal such as iron(III). Representative examples of the bleaching agents include organic complex salts of iron(III), for example, complex salts of aminopolycarboxylic acids (such as ethylenediaminetetraacetic acid, diethylenetriaminepentaacetic acid, cyclohexanediaminetetraacetic acid, methyliminodiacetic acid, 1,3-diaminopropanetetraacetic acid, or glycol ether diaminetetraacetic acid), or complex salts of citric acid, tartaric acid, or malic acid. Of these compounds, iron(III) complex salts of aminopolycarboxylic acids representatively illustrated by iron(III) complex salt of ethylenediaminetetraacetic acid are preferred in view of rapid processing and less environmental pollution associated with its use. Furthermore, iron(III) complex salts of aminopolycarboxylic acids are particularly useful in both bleaching solutions and bleach-fixing solutions.

The pH of the bleaching and bleach fixing solutions in which the aminopolycarboxylic acid iron(III) complex salts are used is normally from 4.0 to 8.0, but processing can be carried out at lower pH in order to speed up processing.

In the bleaching solution, the bleach-fixing solution or a prebath thereof, a bleach accelerating agent can be used, if desired. Specific examples of suitable bleach accelerating agents include compounds having a mercapto group or a disulfide bond as described, for example, in U.S. Pat. No. 3,893,858, West German Patent 1,290,812, JP-A-53-95630, and *Research Disclosure,* No. 17129 (July 1978); thiazolidine derivatives as described, for example, in JP-A-50-140129; thiourea derivatives as described, for example, in U.S. Pat. No. 3,706,561; iodides as described, for example, in JP-A-58-16235; polyoxyethylene compounds as described, for example, in West German Patent 2,748,430; polyamine compounds as described, for example, in JP-B-45-8836; and bromide ions. Of these compounds, the compounds having a mercapto group or a disulfide group are preferred in view of their large bleach accelerating effects. Particularly, the compounds as described in U.S. Pat. No. 3,893,858, West German Patent 1,290,812 and JP-A-53-95630 are preferred. Further the compounds as described in U.S. Pat. No. 4,552,834 are also preferred. These bleach accelerating agents may be incorporated into the color photographic light-sensitive material. These bleach accelerating agents are particularly effectively employed when color photographic light sensitive materials for photographing are subjected to bleach-fix processing.

As fixing agents which can be employed in the fixing solution or bleach-fixing solution, thiosulfates, thiocyanate, thioether compounds, thirureas, or a large amount of iodide are exemplified. Of these compounds, thiosulfates are generally employed. Particularly, ammonium thiosulfate is most widely employed. It is preferred to use sulfites, bisulfites, sulfinic acids such as p-toluenesulfinic acid, or carbonylbisulfite adducts as preservatives in the bleach-fixing solution After a desilvering step, the silver halide color photographic material according to the present invention is generally subjected to a water washing step and/or a stabilizing step.

An amount of water required for the water washing step may be set in a wide range depending on characteristics of photographic light-sensitive materials (due to the components used therein, for example, couplers, etc.), uses thereof, temperature of washing water, a number of water washing tanks (stages), a replenishment system such as countercurrent or cocurrent, or other various conditions. A relationship between a number of water washing tanks and an amount of water in a multi-stage countercurrent system can be determined based on the method as described in *Journal or the Society of Motion Picture and Television Engineers,* Vol. 64, pages 248 to 253 (May, 1955).

According to the multi-stage countercurrent system described in the above literature, the amount of water for washing can be significantly reduced. However, an increase in the staying time of water in a tank can cause propagation of bacteria as well as problems such as the adhesion of floatage formed on the photographic materials. In the method according to the present invention, a method for reducing amounts of calcium ions and magnesium ions as described in JP-A-62-288838 can be particularly effectively employed in order to solve such problems. Further, sterilizers, for example, isothiazolone compounds as described in JP-A-57-8542, cyabendazoles, chlorine-containing sterilizers such as sodium chloroisocyanurate, benzotriazoles, sterilizers as described in Hiroshi Horiguchi, *Bokin-Bobai No Kagaku* (Sankyo Shuppan, 1986), *Biseibutsu No Mekkin-, Sakkin-, Bobai-Gijutsu,* edited by Eiseigijutsu Kai (Kogyogijutsu Kai, 1982), and *Bokin-Bobaizai Jiten,* edited by Nippon Bokin-Bobai Gakkai (1986) can be employed.

The pH of the washing water used in the processing of the photographic light-sensitive materials according to the present invention is usually from 4 to 9, preferably from 5 to 8. The temperature of the washing water and time for the water washing step can be set dependent upon the characteristics or uses of the photographic light-sensitive materials. However, a range of from 15° C. to 45° C. and a period from 20 sec. to 10 min. and preferably a range of from 25° C. to 40° C. and a period from 30 sec. to 5 min. is often employed.

The photographic light-sensitive material of the present invention can also be directly processed with a stabilizing solution in place of the above-described water washing step. In such a stabilizing process, any known methods such as those described, for example, in JP-A-57-8543, JP-A-58-14834 and JP-A-60-220345 can be employed.

Further, it is possible to conduct the stabilizing process subsequent to the above described water washing process One example thereof is a stabilizing bath containing formalin and a surface active agent, which is employed as a final bath in the processing of color photographic light-sensitive materials for photographing. Various chelating agents and antimolds may also be added to the stabilizing bath.

Overflow solutions resulting from the replenishment of the above-described washing water and/or stabilizing solution may be reused in other steps such as a desilvering step.

For the purpose of simplification and acceleration of processing, a color developing agent may be incorporated into the silver halide color photographic material according to the present invention. In order to incorporate the color developing agent, it is preferred to employ various precursors of color developing agents. Suitable examples of the precursors of developing agents include indoaniline type compounds as described in U.S. Pat. Nos. 3,342,597, Schiff's base type compounds as described in U.S. Pat. No. 3,342,599 and *Research Disclosure,* No. 14850 and ibid., No. 15159, aldol compounds as described in *Research Disclosure,* No. 13924, metal salt complexes as described in U.S. Pat. No. 3,719,492, and urethane type compounds as described in JP-A-53-135628.

Further, the silver halide color photographic material according to the present invention may contain, if desired, various 1-phenyl-3-pyrazolidones for the purpose of accelerating color development. Typical examples of the compounds include those as described, for example in JP-A-56-64339, JP-A-57-144547, and JP-A-58-115438.

In the present invention, various kinds of processing solutions can be employed in a temperature range from 10° C. to 50° C. Although a standard temperature is from 33° C. to 38° C., it is possible to carry out the processing at higher temperatures in order to accelerate the processing whereby the processing time is shortened, or at lower temperatures in order to achieve an improvement in the image quality and to maintain the stability of the processing solutions.

Further, for the purpose of saving an amount of silver employed in the color photographic light-sensitive material, the photographic processing may be conducted utilizing color intensification using cobalt or hydrogen peroxide as described in West German Patent 2,226,770 or U.S. Pat. No. 3,674,499.

EXAMPLE 1

A multi-layer color printing paper 101 having the layer structure indicated below, was prepared on a paper support which had been laminated with polyethylene on both sides. The coating liquids were prepared in the way described below.

Preparation of the First Layer Coating Liquid

Ethyl acetate (27.2 ml) and 8.2 grams of solvent (Solv-1) were added to 19.1 grams of yellow coupler (ExY), 4.4 grams of color image stabilizer (Cpd-1) and 0.7 gram of color image stabilizer Cpd-7) to form a solution which was subsequently emulsified and dispersed in 185 ml of 10% aqueous gelatin solution containing 8 ml of 10% sodium dodecylbenznesulfonate. The blue sensitizing dyes indicated below were added to a silver chlorobromide emulsion (comprising a 3:7 (silver mol ratio) mixture of cubic emulsions having average grain sizes 0.88 μm and 0.70 μm, grain size distribution coefficients 0.08 and 0.10, each with 0.2 mol% of silver bromide contained locally on the grain surface) in amounts of $2.0\times10^{-4}$ mol per mol of silver of the large grain emulsion and $2.5\times10^{-4}$ mol per mol of silver of the small grain emulsion. The emulsion was then sulfur sensitized. The aforementioned emulsified dispersion was mixed with this emulsion to provide a first layer coating liquid. The composition was as indicated below.

The coating liquids for the second to the seventh layer were prepared using the same methods as for the first layer coating liquid. 1-Oxy-3,5-dichloro-s-triazine sodium salt was used as a gelatin hardening agent in each layer.

The spectrally sensitizing dyes used in each layer were as indicated below.

Blue Sensitive Emulsion Layer

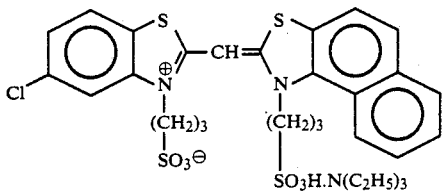

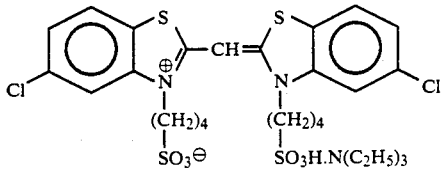

$2.0\times10^{-4}$ mol per mol of silver halide in the large grain emulsion and $2.5\times10^{-4}$ mol per mol of silver halide in the small grain emulsion;

Green Sensitive Emulsion Layer

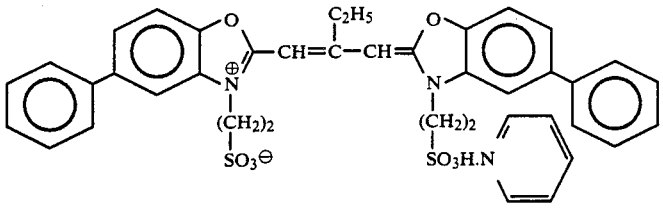

$4.0\times10^{-4}$ mol per mol of silver halide in the large grain emulsion and $5.6\times10^{-4}$ mol per mol of silver halide in 1 the small grain emulsion, and

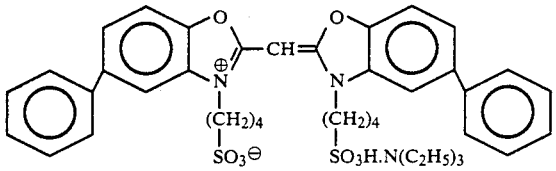

$7.0\times10^{-5}$ mol per mol of silver halide in the large grain emulsion and $1.0\times10^{-5}$ mol per mol of silver halide in the small grain emulsion; and Red Sensitive Emulsion Layer

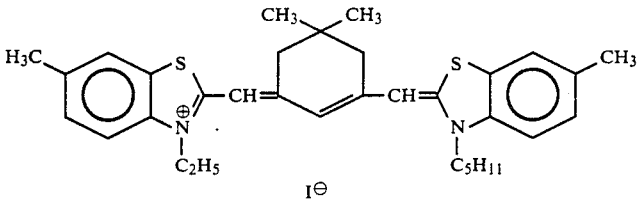

$0.9\times10^{-4}$ mol per mol of silver halide in the large grain emulsion and $1.1\times10^{-4}$ mol per mol of silver halide in the small grain emulsion.

The compound indicated below was added in an amount of $2.6\times10^{-3}$ mol per mol of silver halide to the red sensitive emulsion layer.

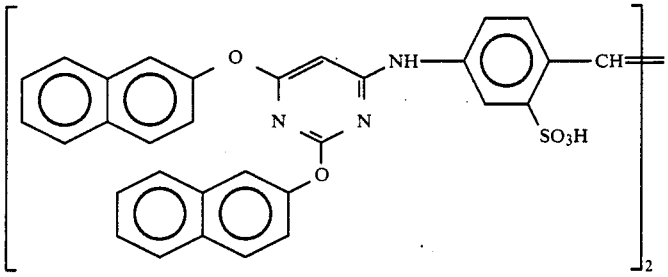

Furthermore, 1-(5-methylureidophenyl)-5-mercaptotetrazole was added to the blue, green and red sensitive emulsion layers in amounts of $8.5\times10^{-5}$ mol, $7.7\times10^{-4}$ mol and $2.5\times10^{-4}$ mol, per mol of silver halide, respectively.

Furthermore, 4-hydroxy-6-methyl-1,3,3*a*,7-tetraazaindene was added in amounts of $1\times10^{-4}$ mol and $2\times10^{-4}$ mol, per mol of silver halide, respectively to the blue and green sensitive emulsion layers.

The dyes indicated below were added to the emulsion layers for anti-irradiation purposes.

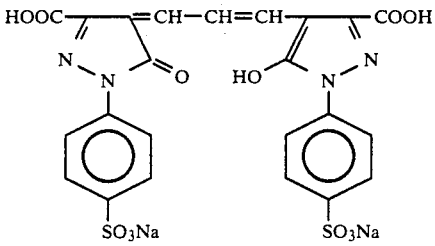

and

-continued

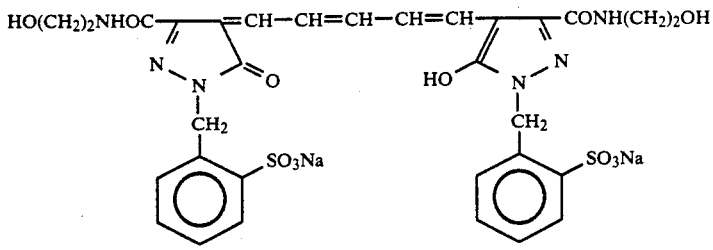

Layer Structure

The composition of each layer is indicated below. The numerical values indicate coated weights ($g/m^2$). In the case of the silver halide emulsion, the coated weight is shown after calculation as silver.

Support

Polyethylene laminated paper

White pigment ($TiO_2$) and a blue dye (ultramarine) were included in the polyethylene on the first layer side.

| | |
|---|---|
| First Layer: Blue Sensitive Layer | |
| The silver chlorobromide described above | 0.30 |
| Gelatin | 1.86 |
| Yellow coupler (ExY) | 0.82 |
| Color image stabilizer (Cpd-1) | 0.19 |
| Solvent (Solv-1) | 0.35 |
| Color image stabilizer (Cpd-7) | 0.06 |
| Second Layer: Anti-color Mixing Agent | |
| Gelatin | 0.40 |
| Anti-color mixing agent (Cpd-5) | 0.06 |
| Ultraviolet absorber (UV-1) | 0.10 |
| Solvent (Solv-1) | 0.05 |
| Solvent Solv-3) | 0.05 |
| Solvent (Solv-4) | 0.05 |
| Third Layer: Green Sensitive Layer | |
| Silver chlorobromide emulsion-a 1:3 (Ag mol ratio) of cubic emulsions of average grain size 0.55 μm and 0.39 μm. The average grain size variation coefficients were 0.10 and 0.08, and each emulsion included 0.8 mol % AgBr locally at the grain surface. | 0.12 |
| Gelatin | 1.24 |
| Magenta coupler (ExM) | 0.20 |
| Color image stabilizer (Cpd-2) | 0.03 |
| Color image stabilizer (Cpd-3) | 0.15 |
| Color image stabilizer (Cpd-4) | 0.02 |
| Color image stabilizer (Cpd-9) | 0.02 |
| Solvent (Solv-2) | 0.40 |

-continued

| | |
|---|---|
| Fourth Layer: Ultraviolet Absorbing Layer | |
| Gelatin | 1.58 |
| Ultraviolet absorber (UV-1) | 0.47 |
| Anti-color mixing agent (Cpd-5) | 0.05 |
| Solvent (Solv-5) | 0.24 |
| Fifth Layer: Red Sensitive Layer | |
| Silver chlorobromide emulsion-a 1:4 (Ag mol ratio) of cubic emulsions of average grain size 0.58 μm and 0.45 μm. The average grain size variation coefficients were 0.09 and 0.11, and each emulsion contained 0.6 mol % AgBr locally at the grain surface. | 0.23 |
| Gelatin | 1.34 |
| Cyan coupler (ExC) | 0.32 |
| Color image stabilizer (Cpd-6) | 0.17 |
| Color image stabilizer (Cpd-7) | 0.40 |
| Color image stabilizer (Cpd-8) | 0.04 |
| Solvent (Solv-6) | 0.15 |
| Sixth Layer: Ultraviolet Absorbing Layer | |
| Gelatin | 0.53 |
| Ultraviolet absorber (UV-1) | 0.16 |
| Anti-color mixing agent (Cpd-5) | 0.02 |
| Solvent (Solv-5) | 0.08 |
| Seventh Layer: Protective Layer | |
| Gelatin | 1.33 |
| Acrylic modified polyvinyl alcohol copolymer (17% modification) | 0.17 |
| Liquid paraffin | 0.03 |

(ExY) Yellow Coupler

A 1:1 (mol ratio) mixture of:

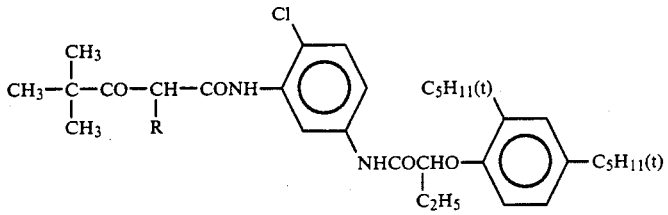

where R = 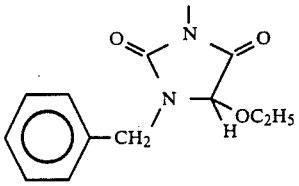 and R = 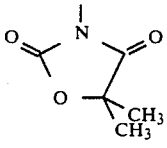

(ExM) Magenta Coupler
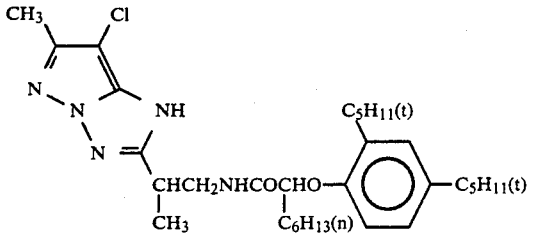
(Ex-C) Cyan Coupler
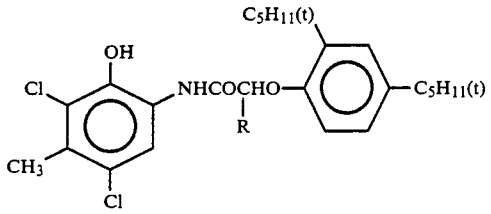
R = $C_2H_5$ and $C_4H_9$
and
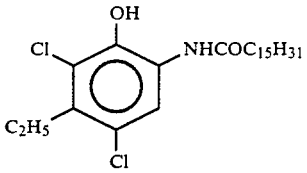
(Cpd-1) Color Image Stabilizer
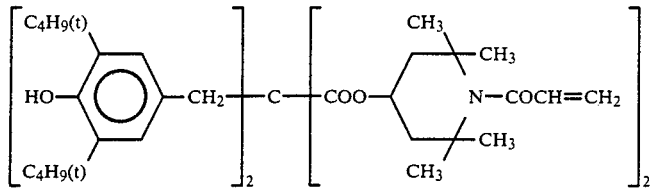
(Cpd-2) Color Image Stabilizer
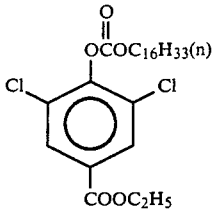
(Cpd-3) Color Image Stabilizer
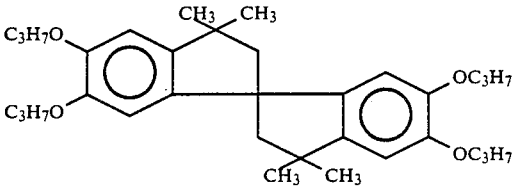
(Cpd-4) Color Image Stabilizer
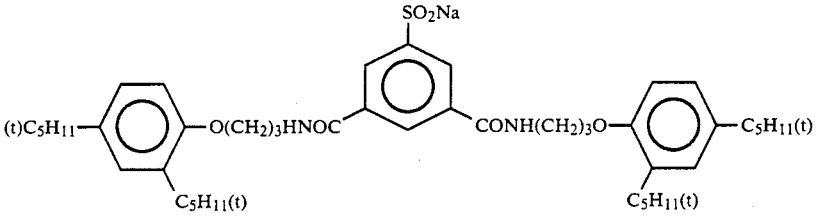
(Cpd-5) Color Image Stabilizer
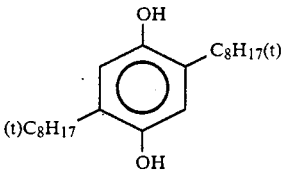
(cpd-6) Color Image Stabilizer
A 2:2:4 (by weight) mixture of:
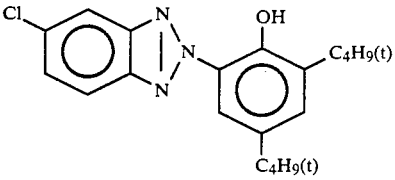

-continued
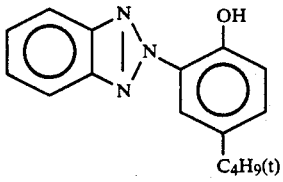
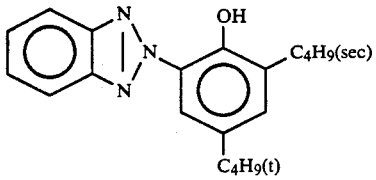
(cpd-7) Color Image Stabilizer
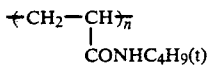
(Average Molecular Weight 60,000)
(Cpd-8) Color Image Stabilizer
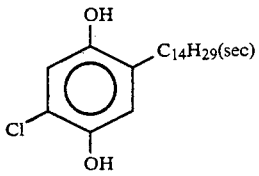
(Cpd-9) Color Image Stabilizer
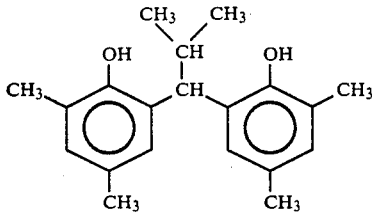
(UV-1) Ultraviolet Absorber
A 4:2:4 (by weight) mixture of:
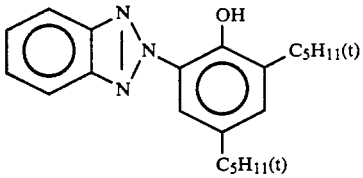
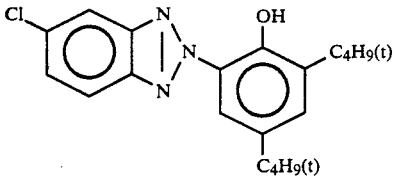
-continued
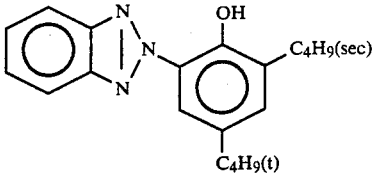
(Solv-1) Solvent
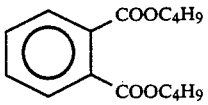
(Solv-2) Solvent
A 2:1 (by volume) mixture of
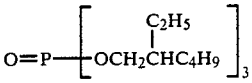
and
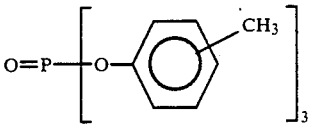
(Solv-3) Solvent
(Solv-4) Solvent
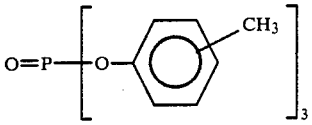
(Solv-5) Solvent
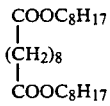
(Solv-6) Solvent
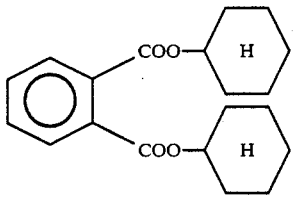

Next, multi-layer color printing papers 102 to 114 were prepared in the same way as color printing paper 101 except that compounds of the present invention were introduced into the second layer (anti-color mixing layer) as shown in Table 1.

Next, the paper samples were given a gradation exposure using three-color separation filters for a sensitometer (Model FWH, made by the Fuji Photo Film Co., Ltd., light source color temperature 3200K). The exposure used at this time was such as to provide an exposure of 250 CMS with an exposure time of 0.1 second.

The exposed samples were subjected to continuous processing (a running test) using a paper processor with the processing operations indicated below until the color developer had been replenished to the extent of twice the tank volume.

| Processing Operation | Temperature | Time | Replenisher* | Tank Capacity |
|---|---|---|---|---|
| Color development | 35° C. | 45 sec. | 161 ml | 17 l |
| Bleach-fix | 30–35° C. | 45 sec. | 215 ml | 17 l |
| Rinse (1) | 30–35° C. | 20 sec. | — | 10 l |
| Rinse (2) | 30–35° C. | 20 sec. | — | 10 l |
| Rinse (3) | 30–35° C. | 20 sec. | 350 ml | 10 l |
| Drying | 70–80° C. | 60 sec. | | |

*Replenishment rate per square meter of photosensitive material (A three tank counter-flow system was used from rinse (3) → rinse (1))

The composition of each processing bath was as indicated below.

Color Developing Solution

| | Tank | Replenisher |
|---|---|---|
| Water | 800 ml | 800 ml |
| Ethylenediamine-N,N,N'N'-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfonamido-ethyl)-3-methyl-4-aminoaniline sulfate | 5.0 g | 7.0 g |
| N,N-Bis(carboxymethyl)hydrazine | 5.5 g | 7.0 g |
| Fluorescent whitener (WHITEX 4B, made by Sumitomo Chemicals) | 1.0 g | 2.0 g |
| Water to make up to | 1000 ml | 1000 ml |
| pH (25° C.) | 10.05 | 10.45 |

Bleach-fixing Solution (Tank Solution-Replenisher)

| | |
|---|---|
| Water | 400 ml |
| Ammonium thiosulfate (70% aqueous solution) | 100 ml |
| Sodium sulfite | 17 g |
| Ethylenediamine tetraacetic acid, ferric ammonium salt | 55 g |
| Ethylenediamine tetraacetic acid, di-sodium salt | 5 g |
| Ammonium bromide | 40 g |
| Water to make up to | 1000 ml |
| pH (25° C.) | 6.0 |

Rinsing Solution (Tank Solution-Replenisher)

Ion exchanged water (Calcium and magnesium both less than 3 ppm)

Next, the magenta density at the point where the yellow density of the part exposed to blue light, i.e., the yellow part is 2.0, of a sample processed in the way described above was measured to evaluate the extent of color mixing. At this time, the magenta density due to the side absorption of the yellow dye (in this case 0.33) was subtracted from the measured magenta density and the resulting value was used as a measure of the extent of color mixing ($\Delta D^G$). Hence, $\Delta D^G=0.00$ when there is no color mixing. The results obtained are shown in Table 1.

It is clear from the results shown in Table 1 that Comparative Sample 101 exhibited magenta color mixing in the yellow colored part and that color dulling had occurred, whereas with Samples 102 to 114 which contained an anti-color mixing promotor according to the present invention in an intermediate layer, there was essentially no color mixing, a bright yellow color was formed and color reproduction was excellent.

TABLE 1

| Sample | Compound of General Formula (I) or (II) Compound | Coated Weight (g/m²) | Extent of Color Mixing ($\Delta D^G$) |
|---|---|---|---|
| 101 (Comp. Ex.) | — | — | 0.21 |
| 102 (Invention) | I-1 | 0.02 | 0.02 |
| 103 (Invention) | I-9 | 0.02 | 0.01 |
| 104 (Invention) | I-21 | 0.02 | 0.00 |
| 105 (Invention) | I-26 | 0.01 | 0.09 |
| 106 (Invention) | I-26 | 0.02 | 0.00 |
| 107 (Invention) | I-35 | 0.01 | 0.08 |
| 108 (Invention) | I-35 | 0.02 | 0.00 |
| 109 (Invention) | I-38 | 0.01 | 0.09 |
| 110 (Invention) | I-38 | 0.02 | 0.02 |
| 111 (Invention) | I-38 | 0.03 | 0.00 |
| 112 (Invention) | I-46 | 0.02 | 0.00 |
| 113 (Invention) | II-5 | 0.03 | 0.01 |
| 114 (Invention) | II-7 | 0.03 | 0.00 |

EXAMPLE 2

Multi-layer color printing papers 201 to 219 were prepared in the same way as Sample 102 except that the anti-color mixing agent, the solvent and the compound of the present invention in the second layer (anti-color mixing layer) in Sample 102 as used in Example 1 were changed as shown in Table 2. These samples were exposed, processed and evaluated with respect to color mixing using the procedure described in Example 1. The results obtained are shown in Table 2.

It is clear from the results shown in Table 2 that changing the type, and increasing the amount of anti-color mixing agent or high boiling point organic solvent in the anti-color mixing layer has little effect on color mixing. Moreover, while color mixing can be reduced in this way the effect is inadequate. But, the use of a comparatively small quantity of a compound according to the present invention can essentially eliminate color mixing.

TABLE 2

| Sample | Anti-color Mixing Agent Compound | Anti-color Mixing Agent Amount Coated ($g/m^2$) | High Boiling Point Solvent Compound | High Boiling Point Solvent Amount Coated ($g/m^2$) | Compound of General Formula (I) or (II) Compound | Compound of General Formula (I) or (II) Amount Coated ($g/m^2$) | Extent of Color Mixing ($\Delta D^G$) |
|---|---|---|---|---|---|---|---|
| 201 (Comp. Ex.) | HQ-1 | 0.06 | S-25 | 0.15 | — | — | 0.24 |
| 202 (Comp. Ex.) | HQ-1 | 0.08 | S-25 | 0.15 | — | — | 0.12 |
| 203 (Comp. Ex.) | HQ-1 | 0.06 | S-25 | 0.17 | — | — | 0.23 |
| 204 (Invention) | HQ-1 | 0.06 | S-25 | 0.15 | I-35 | 0.02 | 0.02 |
| 205 (Invention) | HQ-1 | 0.06 | S-25 | 0.15 | I-43 | 0.02 | 0.03 |
| 206 (Comp. Ex.) | HQ-4 | 0.06 | S-54 | 0.15 | — | — | 0.26 |
| 207 (Invention) | HQ-4 | 0.06 | S-54 | 0.15 | I-21 | 0.02 | 0.02 |
| 208 (Invention) | HQ-4 | 0.06 | S-54 | 0.15 | II-6 | 0.04 | 0.01 |
| 209 (Comp. Ex.) | HQ-9 | 0.05 | S-30 | 0.15 | — | — | 0.31 |
| 210 (Invention) | HQ-9 | 0.05 | S-30 | 0.15 | I-14 | 0.04 | 0.03 |
| 211 (Comp. Ex.) | HQ-14 | 0.04 | S-66 | 0.15 | — | — | 0.20 |
| 212 (Comp. Ex.) | HQ-14 | 0.04 | S-66 | 0.18 | — | — | 0.21 |
| 213 (Invention) | HQ-14 | 0.04 | S-66 | 0.15 | II-7 | 0.03 | 0.01 |
| 214 (Comp. Ex.) | HQ-7 | 0.07 | — | — | — | — | 0.28 |
| 215 (Comp. Ex.) | HQ-7 | 0.10 | — | — | — | — | 0.15 |
| 216 (Invention) | HQ-7 | 0.07 | — | — | I-15 | 0.03 | 0.01 |
| 217 (Invention) | HQ-7 | 0.07 | — | — | II-5 | 0.03 | 0.03 |
| 218 (Comp. Ex.) | RD-7 | 0.04 | S-8 | 0.10 | — | — | 0.19 |
| 219 (Invention) | RD-7 | 0.04 | S-8 | 0.10 | I-38 | 0.03 | 0.03 |

Accordingly, it is possible by using a silver halide photographic material of the present invention to obtain color photograph which exhibits little color mixing and which has excellent color separation and color reproduction, even when it is subjected to rapid processing.

This effect is especially pronounced when pyrazoloazole based color couplers are being used.

Moreover, the effects described above are pronounced when a color development solution which is essentially benzyl alcohol and sulfite ion free is used in the method of forming colored images of the present invention.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon (i) at least one silver halide light-sensitive emulsion layer containing substantially silver iodide free silver halide with a silver chloride content of at least 90 mol%, (ii) at least one coupler which forms a dye by means of a coupling reaction with the oxidized product of a primary aromatic amine developing agent, and (iii) at least one light-insensitive layer containing at least one oil soluble anti-color mixing agent which reacts with the oxidized product of the developing agent, said light-insensitive layer containing at least one oil soluble and substantially non-diffusible anti-color mixing promotor selected from the group consisting of compounds represented by general formula (I) or general formula (II):

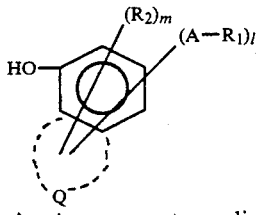

(I)

wherein A represents a divalent electron attractive group, $R_1$ represents an aliphatic group, an aryl group, an alkoxy group, an aryloxy group, ar alkylamino group, an anilino group, a heterocyclic ring-amino group or a heterocyclic group, l represents 1 or 2, $R_2$ represents an aliphatic group, an alkoxy group, a hydroxyl group or a halogen, m represents an integer of value from 0 to 4, and a benzene ring or heterocyclic ring formed by Q may be condensed with the benzene ring, in formula (I);

$$HO-R_3 \qquad (II)$$

wherein $R_3$ represents an aliphatic group having a total number of carbon atoms of at least 12;

said anti-color mixing promotor may form a dimer or more polymer.

2. A silver halide photographic material as in claim 1, wherein the coupler is a pyrazoloazole coupler.

3. A silver halide color photographic material as in claim 1, wherein A in formula (I) represents $$-\overset{\overset{O}{\|}}{\underset{\underset{O}{\|}}{S}}-,\ -\overset{\overset{O}{\|}}{S}-,\ -\overset{\overset{O}{\|}}{C}-\ \text{or}\ -\overset{\overset{O}{\|}}{\underset{\underset{OC_2H_5}{|}}{P}}-.$$

4. A silver halide color photographic material as in claim 1, wherein an aliphatic group in formula (I) or formula (II) is a substituted or unsubstituted linear chain or branched chain alkyl, aralkyl, alkenyl, alkinyl, cycloalkyl or cycloalkenyl group.

5. A silver halide color photographic material as in claim 1, wherein the heterocyclic ring in the heterocyclic ring-amino group or heterocyclic group is a pyrazolyl ring, an imidazolyl ring, a triazolyl ring, a pyridyl ring, a quinolyl ring, a piperidyl ring, or a triazinyl ring.

6. A silver halide color photographic material as in claim 1, wherein the group represented by $R_1$, $R_2$ or $R_3$ is a group substituted with at least one substituent selected from the group consisting of halogen atoms, alkyl groups, aryl groups, heterocyclic groups, a cyano group, alkoxy groups, aryloxy groups heterocyclic ring-oxy groups, aliphatic or aromatic acyloxy groups, carbamoyloxy groups, silyloxy groups, aliphatic or aromatic sulfonyloxy groups, aliphatic or aromatic acylamino groups, anilino groups, ureido groups, imido groups, sulfamoylamino groups, carbamoylamino groups, alkylthio groups, arylthio groups, heterocyclic ring-thio groups, alkoxycarbonylamino groups, aryloxycarbonylamino groups, aliphatic or aromatic sulfonamido groups, carbamoyl groups, aliphatic or aromatic acyl groups, sulfamoyl groups, aliphatic or aromatic sulfonyl groups, aliphatic or aromatic sulfinyl groups, alkoxycarbonyl groups, aryloxycarbonyl groups, alkenyl groups and alkenyloxy groups.

7. A silver halide color photographic material as in claim 1, wherein the total number of carbon atoms in the compound represented by formula (I) is at least 10.

8. A silver halide color photographic material as in claim 1, wherein said light-insensitive layer comprises hydrophilic colloid.

9. A silver halide color photographic material as in claim 1, wherein said anti-color mixing promotor is incorporated into the light-insensitive layer by an oil in water dispersion method.

10. A silver halide color photographic material as in claim 1, wherein said anti-color mixing agent and said anti-color mixing promotor are incorporated into the light-insensitive layer by coemulsification.

11. A silver halide color photographic material as in claim 1, wherein the weight ratio of said anti-color mixing promotor to said anti-color mixing agent ranges from 0.05 to 2.

12. A silver halide color photographic material as in claim 1, wherein the amount of said anti-color mixing agent ranges from 7 to 400 mg/m$^2$.

13. A silver halide color photographic material as in claim 1, wherein said light-insensitive layer is an interlayer provided between two silver halide light-sensitive emulsion layers or an interlayer provided between a silver halide light-sensitive emulsion layer and a protective layer.

14. A silver halide color photographic material as in claim 1, wherein said anti-color mixing agent is a hydroquinone reducing agent.

15. A silver halide color photographic material as in claim 1, wherein said anti-color mixing agent is at least one compound selected from the group consisting of compounds represented by formula (HQ-1), (HQ-2) or (RD-1):

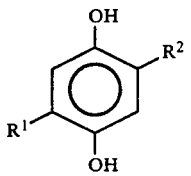

(HQ-1)

wherein $R^1$ and $R^2$, which may be the same or different, each represents a hydrogen atom, or a substituted or unsubstituted alkyl group, and at least one of $R^1$ and $R^2$ is an alkyl group;

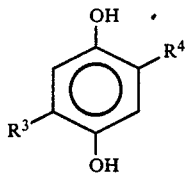

(HQ-2)

wherein $R^3$ represents a substituted or unsubstituted alkyl, alkylthio, amido or alkyloxy group, and $R^4$ represents a sulfo group or a sulfoalkyl groups;

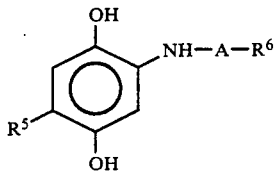

(RD-1)

wherein $R^5$ represents a hydrogen atom, a halogen atom or a substituted or unsubstituted alkyl group, A represents

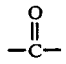

or —$SO_2$—, and $R^6$ represents a substituted or unsubstituted alkyl or aryl group;

said anti-color mixing agent may form of a dimer or more polymer.

16. A silver halide color photographic material as in claim 10, wherein the anti-color mixing agent and the anti-color mixing promotor is coemulsified using at least one of a high boiling point organic solvent selected from the group consisting of compounds represented by formula (III), (IV) or (V):

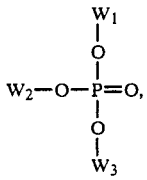

(III)

$W_1$—COO—$W_2$, and (IV)

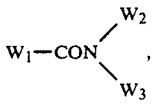

(V)

wherein $W_1$, $W_2$ and $W_3$, which may be the same or different, each represents a substituted or unsubstituted alkyl, cycloalkyl, alkenyl, aryl or heterocyclic group.

17. A silver halide color photographic material as in claim 16, wherein the high boiling point organic solvent/anti-color mixing agent ratio, by weight, is from 0.05 to 20.

* * * * *